US005409806A

United States Patent [19]

Otani

[11] Patent Number: 5,409,806

[45] Date of Patent: Apr. 25, 1995

[54] COLOR PHOTOGRAPHIC MATERIAL AND METHOD FOR FORMING A COLOR IMAGE

[75] Inventor: Shigeaki Otani, Minami-ashigara, Japan

[73] Assignee: Fuji Photo Film Co., Ltd., Kanagawa, Japan

[21] Appl. No.: 159,328

[22] Filed: Nov. 30, 1993

[30] Foreign Application Priority Data

Nov. 30, 1992 [JP] Japan ..... 4-343423

[51] Int. Cl.[6] ..... G03C 1/76

[52] U.S. Cl. ..... 430/505; 430/533; 430/604; 430/605; 430/626

[58] Field of Search ..... 430/533, 604, 605, 626, 430/505

[56] References Cited

U.S. PATENT DOCUMENTS 5,180,659 1/1993 Murai et al. ..... 43 C/626
5,252,454 10/1993 Suzumoto et al. ..... 430/605
5,252,456 10/1993 Ohshima et al. ..... 430/605

FOREIGN PATENT DOCUMENTS

507489A1 10/1992 European Pat. Off. .
512496A2 11/1992 European Pat. Off. .
18548 1/1920 Japan .
125550 4/1992 Japan .

OTHER PUBLICATIONS

James, T. H. ed , The Theory of the Photographic Process, 4th Edition, Macmillan Publishing Co., Inc., 1977, p. 67.

*Primary Examiner*—Janet C. Baxter
*Attorney, Agent, or Firm*—Sughrue, Mion, Zinn, Macpeak & Seas

[57] ABSTRACT

There is disclosed a color photographic material and a method for forming a color image using the said photographic material. The color photographic material has at least three dye-forming coupler-containing layers and comprises a reflective support covered with a water-resistant resin composition containing a white pigment and a thermoplastic resin, an emulsion layer that has a silver chloride content of 95 mol % or more and contains silver chlorobromide grains or silver chloride grains containing specified metal ions, and the color photographic material being hardened by a specified compound.

15 Claims, No Drawings

COLOR PHOTOGRAPHIC MATERIAL AND METHOD FOR FORMING A COLOR IMAGE

FIELD OF THE INVENTION

The present invention relates to a color photographic material and method for forming a color image using the same, and more particularly to a color photographic material that is excellent in reciprocity characteristics with high-illumination-intensity exposure. Even if the period from the exposure to light to the development processing is prolonged for the photographic material that is exposed to light after long-term storage (hereinafter referred to as raw stock storage), the change of the sensitivity is small (it excels in the latent-image stability after raw stock storage).

BACKGROUND OF THE INVENTION

In comparison with electrophotographic materials and the like, silver halide color photographic materials are excellent in high-intensity recording ability. In addition, they are easily handled and are inexpensive. Owing to these features, silver halide color photographic materials are widely used in many fields. One performance of silver halide color photographic materials that is desired to be improved further, however, is the capacity for rapid processing. Also desired and important is the performance capacity to offer users prints of stable quality.

One means of attaining rapid processing ability is to make the content of silver chloride high. Methods wherein an emulsion having a high silver chloride content is used are described, for example, in JP-A ("JP-A" means unexamined published Japanese patent application) Nos. 95345/1983, 232342/1984, and 19140/1985. Also, in the actual marketplace, the content of silver chloride in emulsions used in photographic materials is rapidly being made high.

From the outset of study on the development of photographic materials containing a high-silver-chloride emulsion, it was known that there were such defects as that when a high-silver-chloride emulsion is used, in comparison with conventional high-silver-bromide emulsions, the high-silver-chloride emulsion is hard to give a high sensitivity by usual chemical sensitization. Further, it was known that the reciprocity law failure, in particular, the change in sensitivity and gradation at the time when the photographic material of high-silver-chloride emulsion is exposed to light under high intensity conditions is great. In order to overcome these, various techniques have been developed.

On the other hand, for example, in recent years it is desired to carry out the exposure to light in a short period of time, in order to improve the productivity of photofinishing labs. Further, increasingly images are being formed by the so-called scanner system, wherein an original picture is scanned and, based on its image signal, a photographic material is exposed to high-intensity light for a short period of time, to form an image corresponding to the original image. Consequently, there is increasing demand that, when a photographic material made of a high-silver-chloride emulsion is exposed to high-intensity light for a short period of time, the change in photographic properties is made smaller.

One known method of making the sensitivity of high-silver-chloride emulsions high, or of improving other performance thereof, is to dope the emulsion grains with metal ions. For example, JP-A No. 20853/1990 discloses that, by doping a high-silver-chloride emulsion with a hexacoordinate complex of Re or Os having at least four cyan ligands, high sensitivity is attained. JP-A No. 105940/1989 discloses that a high-silver-chloride emulsion having silver-bromide-rich regions doped selectively with iridium can give an emulsion excellent in reciprocity characteristics without impairing the latent-image stability within a few hours after exposure to light. JP-A No. 132647/1991 discloses that a high-silver-chloride emulsion containing iron ions can give high sensitivity and hard gradation; it can reduce the change in sensitivity due to a change in illumination intensity or in temperature at the time of exposure to light; and it can decrease the desensitization that will be caused by pressure. JP-A Nos. 9034/1992 and 9035/1992 disclose that a high-silver-chloride emulsion containing a specific metal complex with at least 2 cyan ligands can give high sensitivity; it is small in reciprocity law failure and good in latent-image stability; and it can reduce pressure marks. Further, JP-A No. 18548/1990 discloses that, by doping with ions of metals of Group VIII of the Periodic Table, or transition metals of Group II of the Periodic Table, or lead or thallium ions, the change in photographic properties due to multiple exposures that will occur at the time of high-intensity exposure can be reduced.

According to study made by the present inventors, the doping with metal ions described in JP-A No. 18548/1990 improves high-intensity failure and also improves latent-image stability immediately after the production of the photographic material. However, study of the latent-image stability of this photographic material after raw stock storage has revealed the defect that remarkable sensitization occurs after storage of the latent image.

SUMMARY OF THE INVENTION

The object of the present invention is to provide a color photographic material that is excellent in reciprocity characteristics with high-intensity exposure; and wherein, when the photographic material is exposed to light after raw stock storage, and the period from the exposure to light to the development processing is changed, the change of the sensitivity is small (that is, the latent-image stability after raw stock storage is excellent).

The above and other objects, features, and advantages of the invention will be fully apparent by the following description.

DETAILED DESCRIPTION OF THE INVENTION

The object of the present invention can be attained by the following color photographic material and method for forming an image.

(1) A color photographic material having at least one yellow dye-forming coupler-containing emulsion layer, at least one magenta dye-forming coupler-containing emulsion layer, and at least one cyan dye-forming coupler-containing emulsion layer, which respective layers are different in color sensitivity from each other, on a reflective support, which comprises a reflective support consisting of a base paper covered with a water-resistant resin, wherein at least the water-resistant resin covering the surface to be emulsion-coated of the support is made up of a composition containing a white pigment mixed and dispersed into a thermoplastic resin whose major component is a polyester obtained by condensation polymerization of a dicarboxylic acid with a diol; at least one of said emulsion layers that has a silver chloride content of 95 mol % or more and contains silver chlorobromide grains or silver chloride grains containing ions of a metal of Group VIII of the Periodic Table or a transition metal of Group II of the Periodic Table or lead or thallium ions;in an amount of $10^{-9}$ mol or more per mol of the silver halide; wherein the color photographic material is hardened with a compound represented by the following formula (I) and/or a compound represented by the following formula (II):

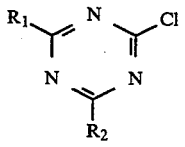

formula (I)

wherein $R_1$ represents a chlorine atom, a hydroxyl group, an alkyl group, an alkoxy group, an alkylthio group, —OM, wherein M represents a monovalent metal atom; $—NR^1R^{11}$ or $—NHCOR^{111}$ wherein $R^1$, $R^{11}$ and $R^{111}$ each represent a hydrogen atom, an alkyl group, or an aryl group; and $R_2$ has the same meaning as that of $R^1$ excluding a chlorine atom,

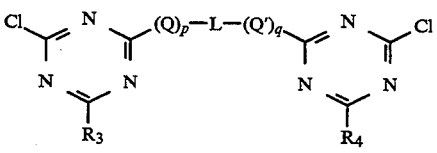

formula (II)

wherein $R_3$ and $R_4$ each represent a chlorine atom, a hydroxyl group, an alkyl group, an alkoxy group, or —OM wherein M represents a monovalent metal atom; Q and Q' each represent a linking group representing —O—, —S—, or —NH—; L represents an alkylene group or an arylene group; and p and q are each 0 or 1.

(2) The color photographic material as stated in (1) above, wherein the polyester on the reflective support is a polyester whose major component is a polyethylene terephthalate.

(3) The color photographic material as stated in (1) above, wherein the water-resistant resin on the surface to be emulsion-coated of reflective support is made up of a composition containing a white pigment mixed and dispersed into a polyester that is a polycondensate of dicarboxylic acid, which acid is a mixture of terephthalic acid and isophthalic acid (preferably in a molar ratio of from 9 : 1 to 2 : 8) with a diol and the other surface of the reflective support is coated with a resin or a resin composition comprising a powder or the like mixed and dispersed into the resin.

(4) The color photographic material as stated in (1) above, wherein the water-resistant resin on the surface to be emulsion-coated of the reflective support is made up of a composition containing a white pigment mixed and dispersed into a polyester that is a polycondensate of dicarboxylic acid, which acid is a mixture of terephthalic acid and naphthalenedicarboxylic acid (preferably in a molar ratio of from 9 : 1 to 2 : 8) with a diol and the other surface of the reflective support is coated with a resin or a resin composition comprising a powder or the like mixed and dispersed into the resin.

(5) The color photographic material as stated in (1) above, wherein the diol is ethylene glycol.

(6) The color photographic material as stated in (1) above, wherein the white pigment in the resin whose major component is a polyester is titanium dioxide and the weight ratio of said white pigment to said resin is from 5 : 95 to 50 : 50.

(7), The color photographic material as stated in (1) above, wherein the emulsion layer contains at least one compound represented by formula (III), (IV), or (V):

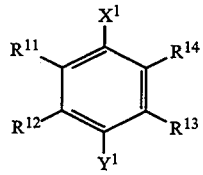

Formula (III)

wherein $X^1$ and $Y^1$ each represent a hydroxyl group, $—NR^{15}R^{16}$, or $—NHSO_2R^{17}$, $R^{11}$, $R^{12}$, $R^{13}$, and $R^{14}$ each represent a hydrogen atom or an arbitrary substituent, or $R^{11}$ and $R^{12}$or $R^{13}$ and $R^{14}$ may bond together to form a carbocyclic ring; $R^{15}$ and $R^{16}$ each represent a hydrogen atom, an alkyl group, an aryl group, or a heterocyclic group, or $R^{15}$ and $R^{16}$ may bond together to form a nitrogen-containing heterocyclic group; and $R^{17}$ represents an alkyl group, an aryl group, an amino group, or a heterocyclic group;

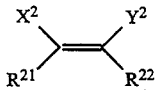

formula (IV)

wherein $X^2$ and $Y^2$ each represent a hydroxyl group, $—NR^{23}R^{24}$, or $—NHSO_2R^{25}$; $R^{21}$ and $R^{22}$ each represents a hydrogen atom or an arbitrary substituent, and $R^{21}$ and $R^{22}$ may bond together to form a carbocyclic ring or a heterocyclic ring; $R^{23}$ and $R^{24}$ each represents a hydrogen atom, an alkyl group, an aryl group, or a heterocyclic group, and $R^{23}$ and $R^{24}$ may bond together to form a nitrogen-containing heterocyclic ring; and $R^{25}$ represents an alkyl group, an aryl group, an amino group, or a heterocyclic group;

$$R^{31}\text{-}(Y^3)_n\text{-}NH\text{-}X^3$$

formula (V)

wherein $X^3$ represents a hydroxyl group or $—NR^{32}R^{33}$, $Y^3$ represents —CO— or $—SO_2—$; $R^{31}$represents a hydrogen atom or an arbitrary substituent; n is 0 or 1; $R^{32}$ and $R^{33}$ each represent a hydrogen atom, an alkyl group, an aryl group, or a heterocyclic group, and $R^{31}$ and $R^{32}$ or $R^{32}$ and $R^{33}$may bond together to form a nitrogen-containing heterocyclic ring.

(8) A method for forming a color image, which comprises exposing a color photographic material, as stated in (1) above, to light in a scanning exposure method with the exposure time being $10^{-4}$ sec or less per picture element, and then color-development processing said exposed color photographic material.

The present invention will now be described in more detail below.

In the specification and claims of the present invention, the term "major component" means that the content of the said component is 50 wt. % or more.

It is necessary that the reflective support in the present invention is covered, on the surface of a base paper on the surface side to be emulsion-coated, with a composition containing a white pigment mixed and dispersed into a resin whose major component is a polyester.

Such a support itself is disclosed in EP 0,507,489A, but EP 0,507,489A neither discloses that specific metal ions are included in silver chlorobromide grains or silver chloride grains and that a specific triazine compound is used as a hardener nor describes that this support affects the raw stock storability.

This polyester is one synthesized by condensation polymerization of a dicarboxylic acid and a diol. As preferable dicarboxylic acids, for example, terephthalic acid, isophthalic acid, and naphthalenedicarboxylic acid can be mentioned. As preferable diols, for example, ethylene glycol, butylene glycol, neopentyl glycol, triethylene glycol, butanediol, hexylene glycol, an adduct of bisphenol A with ethylene oxide (2,2-bis(4-(2-hydroxyethyloxy)phenyl)propane), and 1,4-dihydroxymethylcyclohexane can be mentioned.

In the present invention, various polyesters prepared by condensation polymerization of one or a mixture of these dicarboxylic acids with one or a mixture of these diols can be used. In particular, at least one of the dicarboxylic acids is preferably terephthalic acid. As the dicarboxylic acid component, a mixture of terephthalic acid and isophthalic acid (in a molar ratio of from 9 : 1 to 2 : 8), or a mixture of terephthalic acid and naphthalenedicarboxylic acid (in a molar ratio of from 9 : 1 to 2 : 8), is also preferably used. As the diol, ethylene glycol or a mixed diol containing ethylene glycol is preferably used. Preferably the molecular weight of these polymers is 30,000 to 50,000.

Also, a mixture of two or more of these polyesters having different compositions is preferably used. Further, a mixture of these polyesters with other resins can also be used preferably. As the other resins that can be mixed, wide varieties of resins that can be extruded at 270° to 350° C. can be chosen, such as polyolefins, for example polyethylenes and polypropylenes; polyethers, for example polyethylene glycols, polyoxymethylenes, and polyoxypropylenes; polyester polyurethanes; polyether polyurethanes; polycarbonates; and polystyrenes. One or more of these resins can be blended. For instance, 90 wt. % of a polyethylene terephthalate can be mixed with 6 wt. % of a polyethylene and 4 wt. % of a polypropylene. Although the mixing ratio of the polyester to the other resin varies depending on the type of the resin to be mixed, in the case of polyolefins, suitably the weight ratio of the polyester to the other resin is from 100 : 0 to 80 : 20. If the ratio falls outside this range, the physical properties of the mixed resin drop drastically. In the case of resins other than polyolefins, the polyester is mixed with the resin in a weight ratio ranging from 100 : 0 to 50 : 50. If the weight % of the polyester is too Small, the effect of the present invention cannot be obtained satisfactorily.

As the white pigment to be mixed and dispersed into the polyester of the reflective support in the present invention, inorganic pigments, such as titanium oxide, barium sulfate, lithopone, aluminum oxide, calcium carbonate, silicon oxide, antimony trioxide, titanium phosphate, zinc oxide, white lead, and zirconium oxide; and organic finely divided powders, such as finely divided powders of a polystyrene and a styrene/divinylbenzene copolymer, can be mentioned.

Among these pigments, titanium dioxide is particularly effectively used. The titanium dioxide may be of the rutile type or the anatase type, and it may be one prepared by either the sulfate process or the chloride process. The pigment can be commercially available, such as KA-10 and KA-20, manufactured by Titan Kogyo and A-220, manufactured by Ishihara Sangyo.

Preferably, the white pigment to be used has an average particle diameter of 0.1 to 0.8 μm. If the particle diameter is too small, it is difficult to disperse the pigment uniformly into the resin. On the other hand, if the particle diameter is too large, the whiteness becomes unsatisfactory and the coated surface becomes rough, thereby adversely affecting the image quality.

The mixing weight ratio of the polyester to the white pigment is from 98 : 2 to 30 : 70, preferably from 95 : 5 to 50 : 50, and particularly preferably from 90 : 10 to 60 : 40. If the amount of the white pigment is too small, the whiteness is insufficient; while if the amount is too large, the smoothness of the surface of the obtained support for photographic paper is unsatisfactory and a support for photographic paper excellent in glossiness cannot be obtained.

The polyester and the white pigment are mixed together with a dispersing agent, such as a metal salt of a higher fatty acid, a higher fatty acid ethyl ester, a higher fatty acid amide, and a higher fatty acid, by a kneader, such as a twin roll, a triplet roll, a kneader, and a Banbury mixer. Into the resin layer, an antioxidant may be contained in the resin layer in an amount of 50 to 1,000 ppm based on the resin.

The thickness of the polyester/white pigment composition that is coated on the surface to be emulsion-coated of the base paper of the present reflective support is preferably 5 to 100 μm, more preferably 5 to 80 μm, and particularly preferably 10 to 50 μm. If the thickness is too thick, problems related to the physical properties arise and, for example, the resin becomes too brittle and cracks. On the other hand, if the thickness is too thin, the waterproofness of the coating that is originally intended is apt to be damaged; in addition, the whiteness and the surface smoothness cannot be satisfied simultaneously; and with respect to the physical properties the coating becomes too soft.

Preferably the thickness of the resin or the resin composition that covers the surface opposite to the emulsion-coated surface of the base paper is 5 to 100 μm, more preferably 10 to 50 μm; and if it is too thick, problems related to the physical properties arise and, for example, the resin becomes too brittle and cracks. If it is too thin, the waterproofness of the covering that is originally intended is impaired; and in addition with respect to the physical properties the covering becomes too soft. The resin or the resin composition for use on this surface preferably also comprises a polyester. As specified examples of polyester, those mentioned as examples for use on the surface to be emulsion-coated can be preferably used.

As a process for covering the surface to be emulsion-coated and the opposite surface, for example, the melt extrusion lamination process can be mentioned.

The base paper used for the base of the reflective support of the present invention is chosen from materials generally used for photographic paper. That is, the main raw material is natural pulp from, for example, softwoods or hardwoods, to which, if necessary, is added, for example, a filler, such as clay, talc, calcium carbonate, and urea resin fine particles, a sizing agent, such as a rosin, an alkylketene dimer, a higher fatty acid, an epoxidized fatty acid amide, paraffin wax, and an alkenyl succinate, a paper strength reinforcing agent, such as a starch, a polyamide polyamine epichlorohydrin, and a polyacrylamide, and a fixing agent, such as aluminum sulfate, and a cationic polymer.

Although the kind and thickness of the base paper are not particularly restricted, desirably the basis weight is 50 g/m$^2$ to 250 g/m$^2$. Preferably, the base paper is surface-treated by applying heat and pressure thereto, for example, by a machine calender or a supercalender in order to increase the smoothness and flatness of the support.

The above smoothness is represented by using the surface roughness of the support as a scale. This surface roughness of the support will now be described.

The surface roughness uses the center line average surface roughness as a scale.

The center line average surface roughness is defined as follows. An area SM is cut out from the rough curved surface at the center surface thereof, the X-axis and the Y-axis of the rectangular coordinate axes are placed on the center line of the cutout, the axis orthogonal to the center line is assumed to be the Z-axis, and then the value given by the following expression is defined as the center line average surface roughness (SRa) in $\mu$m.

$$SRa = \frac{1}{SM}\int_0^{L_X}\int_0^{L_Y}|f(X, Y)|\,dX \cdot dY$$

wherein LxLy=SM and Z=f(X,Y)

The values of the center line average surface height and the height of the projection from the center line can be found by measuring an area of 5 mm$^2$ using, for example, a three-dimensional surface roughness tester (SE-30H, manufactured by Kosaka-kenkyusho KK), which has a diamond needle having a diameter of 4 $\mu$m, with the cutoff value being 0.8 mm, the horizontal scale-up ratio being 20, and the vertical scale-up ratio being 2,000. At that time, the feeding speed of the sensing needle is preferably on the order of 0.5 mm/sec. Based on this measurement, preferably, the support has a value of 0.15 $\mu$m or less, more preferably 0.10 $\mu$m or less. Using a support having such a surface roughness (smoothness), a color print having a surface excellent in smoothness can be obtained.

Before the base paper is coated with the mixed composition of a polyester and a white pigment, preferably the surface of the base paper is pretreated, for example, with a corona discharge treatment, a flame treatment, or an undercoat.

When a polyester, such as a polyethylene terephthalate, is used, since the adhesion to the photographic emulsion is weak in comparison with the case wherein a polyethylene is used, preferably, after the melt extrusion lamination of the polyester to the base paper, the polyester surface is subjected to a corona discharge treatment and a hydrophilic colloid layer is applied.

Also preferably the surface of the thermoplastic resin mainly made up of a polyester is coated with an undercoat liquid containing a compound represented by the following formula (U):

formula (U)

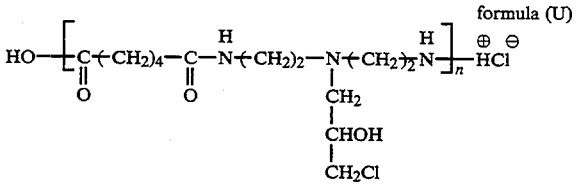

Preferably the coating amount of the compound represented by formula (U) is 0.1 mg/m$^2$ or more, more preferably 1 mg/m$^2$ or more, and most preferably 3 mg/m$^2$ or more, and the larger the amount is, the higher the adhesion can be increased, but an excessive amount is disadvantageous in view of cost.

In order to improve the coating performance of the undercoat solution to the resin surface, preferably alcohols, such as methanol, are added. In this case, the proportion of the alcohols is preferably 20 wt. % or more, more preferably 40 wt. % or more, and most preferably 60 wt. % or more. To improve the Coating performance further, various surface-active agents, such as anionic surface-active agents, cationic surface-active agents, nonionic surface-active agents, fluorine-containing surface-active agents, and organosilicon surface-active agents, are preferably added.

Further, preferably, a water-soluble polymer, such as gelatin, is added to the undercoating solution in order to obtain a good undercoated surface.

In view of the stability of the compound of formula (U) into consideration, preferably the pH of the solution is 4 to 11, more preferably 5 to 10.

Before applying the undercoat solution, preferably the thermoplastic resin is surface treated. As the surface treatment, for example, a corona discharge treatment, a flame treatment, or a plasma treatment can be used.

To apply the undercoat solution, a generally well-known coating process can be used, such as a gravure coating process, a bar coating process, a dip coating process, an air-knife coating process, a curtain coating process, a roller coating process, a doctor coating process, and an extrusion coating process.

The drying temperature of the coat is preferably 30° to 100° C., more preferably 50° to 100° C., and most preferably 70° to 100° C.; the upper limit is determined by the heat resistance of the resin, and the lower limit is determined by the production efficiency.

The metal ion to be contained in the silver halide grains in the present invention is at least one of metal ions derived, for example, from metals of Group VIII of the Periodic Table, such as iron, iridium, platinum, palladium, nickel, rhodium, osmium, ruthenium, and cobalt; metals of Group II of the Periodic Table, such as cadmium, zinc, and mercury; and lead and thallium. In particular, ions of transition metals, such as iron, iridium, platinum, palladium, nickel, and rhodium, are preferable. Specific examples of compounds containing these metal ions are given below, but the present invention is not restricted to them: ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric alubinate, ammonium ferric acetate, ferric bromide, ferric chloride, ferric chromate, ferric citrate, ferric fluoride, ferric formate, ferric glycerophosphate, ferric hydroxide, acid ferric phosphate, ferric nitrate, ferric phosphate, ferric pyrophosphate, sodium ferric pyrophosphate, ferric thiocyanate, ferric sulfate, ammonium ferric sulfate, guanidine ferric sulfate, ammonium ferric citrate, potassium hexacyanoferrate(II), potassium pentacyanoamine-ferrate(II), sodium ferric ethylenedinitrilo tetraacetate, potassium hexacyanoferrate(III), ferric tris(dipyridyl) chloride, potassium pentacyanonitrosylferrate(II), ferric hexaurea chloride, iridium(III) chloride, iridium(III) bromide, iridium(IV) chloride, sodium hexachloroiridate(III), potassium hexachloroiridate(IV), hexamineiridium(III) salt, hexamineiridium(IV) salt, trioxalatoiridium(III) salt, trioxalatoiridium(IV) salt, platinum(Iv) chloride, potassium hexachloroplatinate(IV), tetrachloroplatinic(II) acid, tetrabromoplatinic(II) acid, sodium tetrakis(thiocyanato)platinate(IV), hexamineplatinum(IV) chloride, sodium tetrachloropalladate(II), sodium tetrachloropalladate(IV), potassium hexachloropalladate(IV), tetraminepalladium(II) chloride, potassium tetracyanopalladate(II), nickel chloride, nickel bromide, potassium tetrachloronickelate(II), hexaminenickel(II) chloride, sodium tetracyanonickelate(II), potassium hexachlororhodiate, sodium hexabromorhodiate, and ammonium hexachlororhodiate. Among above-mentioned metal compounds, complexes of metal of Group VIII of the Periodic Table are preferable.

In the present invention, metal ions described above are contained in at least one emulsion layer that contains silver chlorobromide or silver chloride grains having a silver chloride content of 95 mol. % or more. To incorporate the metal ions to be used in the present invention in the localized phase of silver halide grains and/or in some other grain part (substrate), the metal ions may be added before or during the formation of the grains, or they may be added to the prepared liquid during its physical ripening. For example, the metal ions can be added to an aqueous gelatin solution, an aqueous halide solution, an aqueous silver salt solution, or other aqueous solution, to form silver halide grains.

Alternatively, the metal ions may be already contained in silver halide fine grains, which grains are then added to a desired silver halide emulsion, resulting in the grains becoming dissolved, so that the metal ions are introduced. This technique is effective to introduce the metal ions into the silver-bromide-localized phase present on the silver halide grain surface. The method for adding can be suitably changed according to where the metal ions are to be present in the silver halide grains.

The content of the metal ions used in the present invention is $10^{-9}$ mol or more, preferably $10^{-9}$ or more but $10^{-3}$ or less, and further more preferably $10^{-8}$ or more but $10^{-3}$ or less, per mol of the silver halide.

In the present invention, it is required that, as the silver halide grains, silver chloride grains, silver chlorobromide grains, or silver bromochloroiodide grains containing 95 mol. % or more of silver chloride are used. Particularly, in the present invention, in order to shorten the development processing time, silver chlorobromide grains or silver chloride grains substantially free from silver iodide can preferably be used. Herein the expression "substantially free from silver iodide" means that the silver iodide content is 1 mol. % or less, preferably 0.2 mol. % or less. On the other hand, for the purpose of increasing high-intensity sensitivity, spectral sensitization sensitivity, or long-term stability of the photographic material, there is a case wherein high-silver-chloride grains containing 0.01 to 3 mol. % of silver iodide on the emulsion surface is preferably used as described in JP-A No. 84545/1991. Although the halogen composition of the emulsion may be different or uniform from grain to grain, when an emulsion having a halogen composition uniform from grain to grain is used, the properties of the grains can be easily made homogeneous. With respect to the halogen composition distribution in the silver halide emulsion grains, for example, grains having the so-called uniform-type structure, wherein the halogen composition is uniform throughout the grains; grains having the so-called layered-type structure, wherein the halogen composition of the core in the silver halide grains is different from that of the shell (consisting of a layer or layers) surrounding the core; or grains having a structure wherein non-layered parts different in halogen composition are present in the grains or on the surface of the grains (if the non-layered parts different in halogen composition are present on the surface of the grains, they may be joined to the edges, corners, or planes of grains) may suitably be chosen. To secure a high sensitivity, it is more advantageous to use one of the latter two than to use grains having a uniform-type structure and the latter two are also preferable in view of pressure-resistance properties. If the silver halide grains have the above structure, the boundary of parts different in halogen composition may be a clear boundary, an obscure boundary formed by a mixed crystal due to the difference of the composition, or a boundary wherein the structure is continuously changed positively.

In the high-silver-chloride emulsion for use in the present invention, preferably the silver bromide localized phase is layered or non-layered in the silver halide grains and/or on the surface of the grains as described above. The halogen composition of the above localized phase preferably has a silver bromide content of at least 10 mol. %, more preferably the content is more than 20 mol. %. The silver bromide content of the silver bromide localized layer can be analyzed, for example, by using the X-ray diffraction method (described, for example, in *Shin-jikkenkagaku-koza* 6, Kozokaiseki, edited by Nihonkagakukai, published by Maruzen). The localized phase may be present in the grains or on the edges, corners, or planes of the grains and one preferable example is one wherein the localized phase is grown epitaxially on the corners of the grains.

For the purpose of decreasing the replenishing amount of the development processing solution, it is effective to increase further the silver chloride content of the-silver halide emulsion. In that case, an emulsion comprising nearly pure silver chloride, for example an emulsion having a silver chloride content of 98 to 100 mol. %, is also preferably used.

The average grain size of the silver halide grains contained in the silver halide emulsion used in the present invention (the average grain size is calculated in such a way that, by assuming the diameters of circles equivalent to the projected areas of the grains to be the grain sizes, its number average is designated as the average grain size) is preferably 0.1 to 2 μm.

The grain size distribution of them is preferably a monodisperse distribution wherein the deviation coefficient (which is obtained by dividing the standard deviation of the grain size distribution by the average grain size) is preferably 20% or less, desirably 15% or less, and more preferably 10% or less. At that time, for the purpose of obtaining a wide latitude, it is also preferably carried out that such monodisperse emulsions are blended to be used in one layer or are applied in layers.

With respect to the form of the silver halide grains contained in the photographic emulsion, a regular crystal form, such as a cubic form, a tetradecahedral form, or an octahedral form, an irregular crystal form, such as a sphere form or a tabular form, or a composite of these can be used. Also a mixture of various crystal forms can be used. In the present invention, it is desired that, out of these, the above regular crystal form amounts to 50% or more, preferably 70% or more, and more preferably 90% or more, in the grains.

Besides these, an emulsion wherein tabular grains having an average aspect ratio (the diameter/thickness in terms of circles) of 5 or more, preferably 8 or more, amount to over 50% in all the grains in terms of projected areas can be preferably used.

The silver (bromo)chloride emulsion used in the present invention can be prepared by processes described, for example, by P. Glafkides in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, and the like can be used and to react a soluble silver salt with a soluble halide, any of the single-jet method, the double-jet method, a combination of these, and the like can be used. A method wherein grains are formed in an atmosphere of excess silver ions (so-called reverse precipitation method) can also be used. As one type of the reverse precipitation method, a method wherein the pAg in the liquid phase wherein the silver halide will be formed is kept constant, that is, the so-called controlled double-jet method can be used. According to this method, a silver halide emulsion wherein the crystal form is regular and the grain size is nearly uniform can be obtained.

Generally the silver halide emulsion used in the present invention is chemically and spectrally sensitized.

With respect to the chemical sensitization, a chemical sensitization, which uses a chalcogen sensitizer (specifically, sulfur sensitization, which typically includes the addition of an unstable sulfur compound; selenium sensitization, which uses a selenium compound; or tellurium sensitization, which uses a tellurium compound), a noble metal sensitization, which typically includes gold sensitization, and a reduction sensitization can be used alone or in combination. With respect to compounds used in chemical sensitization, those described in JP-A No. 215272/1987, page 18 (the right lower column) to page 22 (the right upper column), are preferably used.

Effects of the photographic material constitution of the present invention can be obtained when a gold-sensitized high-silver-chloride emulsion is used.

The emulsion for use in the present invention is a so-called surface latent image-type emulsion, wherein a latent image is mainly formed on the grain surface.

The hardening agent for use in the present invention is chosen from compounds represented by formula (I) and/or compounds represented by formula (II).

The alkyl group represented by $R_1$ and $R_2$ of formula (I) includes, for example, methyl, ethyl, and butyl, and the alkoxy group represented by $R_1$ and $R_2$ includes, for example, methoxy, ethoxy, and butoxy. M of the group —OM represented by $R_1$ and $R_2$ includes, an alkali metal such as a sodium atom and a potassium atom.

The cyanuric chloride-type hardening agent represented by formula (I) are described in U.S. Pat. No. 3,645,743, JP-B ("JP-B" means examined Japanese patent publication) Nos. 6151/1972, 33380/1972, and 9607/1976, and JP-A Nos. 19220/1973, 78788/1976, 60612/1977, 128130/1977, 130326/1977, and 1043/1981 and they can be used taking the above criteria into consideration.

The alkyl group represented by $R_3$ and $R_4$ of formula (II) includes, for example, methyl, ethyl, and butyl, the alkoxy group represented by $R_3$ and $R_4$ includes methoxy, ethoxy, and butoxy, and M of the group —OM includes an alkali metal, for example, a sodium atom and a potassium atom.

The alkylene group represented by L includes, for example, methylene, ethylene, and propylene, and the arylene group represented by L includes, for example, a p-, o-, or m-phenylene.

The cyanuric chloride type hardening agents represented by formula (II) are described in Canadian Patent No. 895,808, JP-B No. 33542/1983, and JP-A No. 40244/1982, and they can be used taking the above criteria into consideration.

Since the compounds represented by formulas (I) and (II) according to the present invention will diffuse into all the applied layers, the compound may be added to at least one or more layers selected from the emulsion layers or auxiliary layers involved in the present invention. The addition of these compounds is carried out by dissolving,the compound in water or an alcohol (e.g., methyl alcohol or ethyl alcohol) in an amount of 1 to 100 mg, preferably 5 to 50 mg, per gram of the gelatin. The addition may be carried out by batchmode or inlinemode with the latter preferred.

Typical specific examples of the compound represented by formula (I) or (II) are listed below, but the present invention is not restricted to them.

The compounds represented by formula (I):

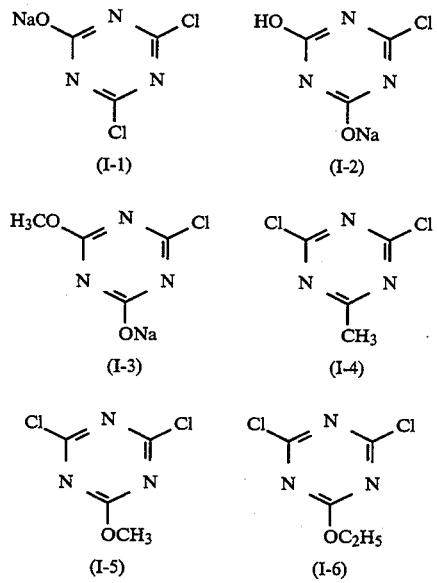

-continued

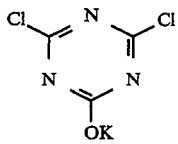

(I-7)

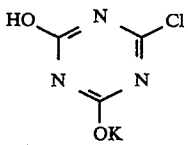

(I-8)

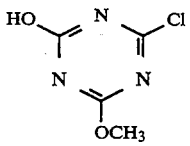

(I-9)

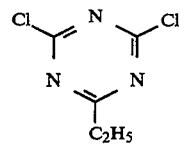

(I-10)

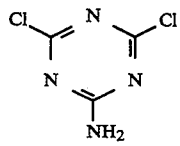

(I-11)

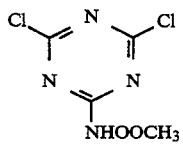

(I-12)

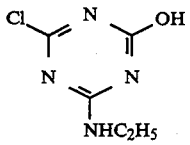

(I-13)

The compounds represented by formula (II):

(II-1)

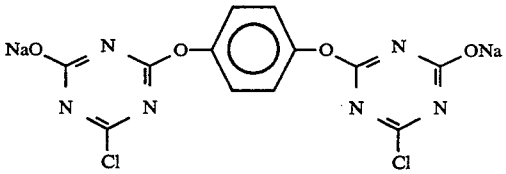

(II-2)

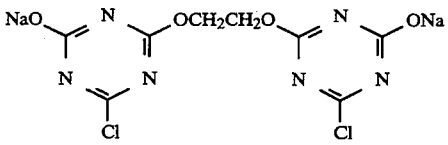

(II-3)

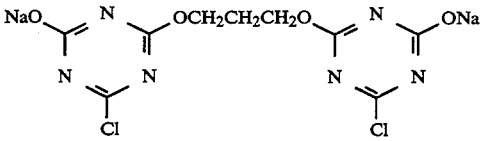

(II-4)

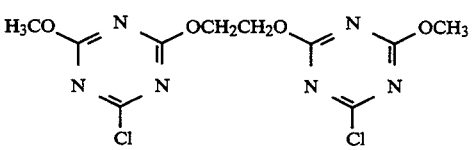

(II-5)

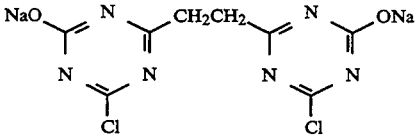

-continued (II-6)

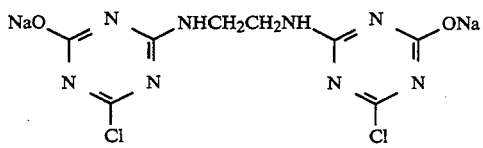

(II-7)

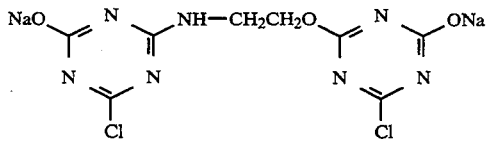

(II-8)

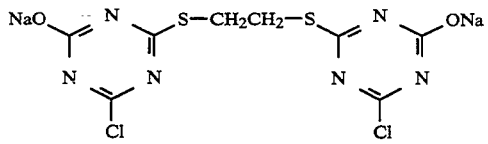

(II-9)

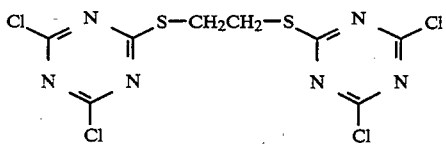

(II-10)

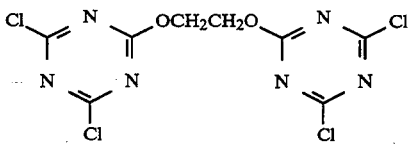

JP-A No. 12550/1992, for example, discloses that the increase in fogging and the change in sensitivity due to raw stock storage can be suppressed by using, as a hardening agent, such a triazine compound as is mentioned above, but that publication does not at all describe latent-image stability after raw stock storage.

The compound represented by formula (III), (IV), or (V) may be included in a photographic constitutional layer, preferably in a silver halide emulsion layer or intermediate layer. The effect of the present invention is made more remarkable by inclusion of the compound represented by formula (III), (IV), or (V) in the silver halide emulsion layers. To include these compounds in the emulsion layers, they may be directly dispersed in the emulsion or may first be dissolved in water, or a solvent, such as methanol, or a mixed solvent, after which they are then added to the emulsion. The addition thereof to the emulsion may be carried out at any stage from the preparation of the emulsion to the point just before the application, and preferably the addition is carried out when the coating liquid is prepared. Preferably the amount of the compounds represented by formulas (III), (IV), or (V) to be added is $1\times10^{-5}$ to 1 mol, more preferably $1\times10^{-3}$ to $5\times10^{-1}$ mol, per mol of the silver halide.

The compound of formula (III) will now be described in more detail.

In formula (III), $X^1$ and $Y^1$ each represent a hydroxyl group, $-NR^{15}R^{16}$, or $-NHSO_2R^{17}$ and $R^{11}$, $R^{12}$, $R^{13}$, and $R^{14}$ each represent a hydrogen atom or an arbitrary substituent. The arbitrary substituent includes, for example, an alkyl group (preferably, having 1 to 20 carbon atoms, e.g., methyl, ethyl, octyl, hexadecyl, and t-butyl), an aryl group (preferably having 6 to 20 carbon atoms, e.g., phenyl and p-tolyl), an amino group (preferably having 0 to 20 carbon atoms, e.g., amino, diethylamino, diphenylamino, and hexadecylamino), an amido group (preferably having 1 to 20 carbon atoms, e.g., acetylamino, benzoylamino, octadecanoylamino, and benzenesulfonamido), an alkoxy group (preferably having 1 to 20 carbon atoms, e.g., methoxy, ethoxy, and hexadecyloxy), an alkylthio group (preferably having 1 to 20 carbon atoms, e.g., methylthio, butylthio, and octadecylthio), an acyl group (preferably having 1 to 20 carbon atoms, e.g., acetyl, hexadecanoyl, benzoyl, and benzenesulfonyl), a carbamoyl group (preferably having 1 to 20 carbon atoms, e.g., carbamoyl, N-hexylcarbamoyl, and N,N-diphenylcarbamoyl), an alkoxycarbonyl group (preferably having 2 to 20 carbon atoms, e.g., methoxycarbonyl and octyloxycarbonyl), a hydroxyl group, a halogen atom (e.g., F, Cl, and Br), a cyano group, a nitro group, a sulfo group, and a carboxyl group. These substituents may be further substituted by other substituent (such as those mentioned for $R^{11}$). $R^{11}$ and $R^{12}$ or $R^{13}$ and $R^{14}$ may bond together to form a carbocyclic ring (preferably a 5- to 7-membered ring). $R^{15}$ and $R^{16}$ each represent a hydrogen atom, an alkyl group (preferably having 1 to 10 carbon atoms, e.g., ethyl, hydroxyethyl, and octyl), an aryl group (preferably having 6 to 10 carbon atoms, e.g., phenyl and naphthyl), or a heterocyclic group (preferably having 2 to 10 carbon atoms, e.g., 2-furanyl and 4-pyridyl), which may be further substituted by a substituent (e.g., those mentioned for $R^{11}$). $R^{15}$ and $R^{16}$ may bond together to form a heterocyclic ring (preferably a 5- to 7-membered ring). $R^{17}$ represents an alkyl group (preferably having 1 to 20 carbon atoms, e.g., ethyl, octyl, and hexadecyl), an aryl group (preferably having 6 to 20 carbon atoms, e.g., phenyl, p-tolyl, and 4-dodecyloxyphenyl), an amino group (preferably having 0 to 20 carbon atoms, e.g., N,N-diethylamino, N,N-diphenylamino, and morpholino), or a heterocyclic group (preferably having 2 to 20 carbon atoms, e.g., 3-pyridyl), which may be further substituted.

In formula (III), preferably $X^1$ represents —NH-$SO_2R^{17}$ and preferably $R^{11}$, $R^{12}$, $R^{13}$, and $R^{14}$ each represent a hydrogen atom, an .alkyl group, an amido group, a halogen atom, a sulfo group, or a carboxyl group.

Formula (IV) will be further described in more detail.

In formula (IV), $X^2$ and $Y^2$ each represent a hydroxyl group, —$NR^{23}R^{24}$, or —$NHSO_2R^{25}$. $R^{21}$ and $R^{22}$ each represent a hydrogen atom or an arbitrary substituent. The arbitrary substituent includes, for example, those mentioned for $R^{11}$. $R^{21}$ and $R^{22}$ may bond together to form a carbocyclic or heterocyclic ring (preferably a 5- to 7-membered ring). $R^{23}$ and $R^{24}$ each represent a hydrogen atom, an alkyl group, an aryl group, or a heterocyclic group, the details of which are the same as those of $R^{15}$. $R^{23}$ and $R^{24}$ may bond together to form a nitrogen-containing heterocyclic ring (preferably a 5- to 7-membered ring). $R^{25}$ represents an alkyl group, an aryl group, an amino group, or a heterocyclic ring, the details of which are the same as those $R^{17}$.

In formula (IV), preferably $X^2$ represents —$NR^{23}R^{24}$, or —$NHSO_2R^{25}$ and preferably $R^{21}$ and $R^{22}$ each represent a hydrogen atom, an alkyl group, or an aryl group, or they may bond together to form a carbocyclic ring or a heterocyclic ring. Details of these groups are the same as those for $R^{15}$.

Formula (V) will now be described in more detail.

In formula (V), $X^3$ represents a hydroxyl group or —$NR^{32}R^{33}$ and $Y^3$ represents —CO— or —$SO_2$—. $R^{31}$ represents a hydrogen atom or an arbitrary substituent (e.g., those mentioned for $R^{11}$) and n is 0 or 1.

$R^{32}$ and $R^{33}$ each represent a hydrogen atom, an alkyl group, an aryl group, or a heterocyclic group, the details of which are the same as those for $R^{15}$. $R^{31}$ and $R^{32}$ or $R^{32}$ and $R^{33}$ may bond together to form a heterocyclic ring (preferably a 5- to 7-membered ring).

In formula (V), preferably $X^3$ represents —$NR^{32}R^{33}$ and preferably $Y^3$ represents —CO—. Preferably $R^{31}$ represents a hydrogen atom, an alkyl group, an aryl group, an alkoxy group, an aryloxy group, or an amino group, which may be further substituted by an arbitrary substituent (e.g., those mentioned for $R^{11}$). Preferably $R^{32}$ and $R^{33}$ each represent a hydrogen atom or an alkyl group.

Specific examples of the compounds represented by formulas (III), (IV), and (V) used in the present invention are listed below, but the present invention is not restricted to them.

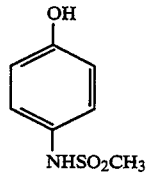

(III)-1

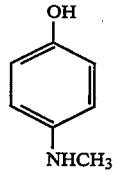

(III)-2

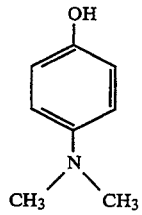

(III)-3

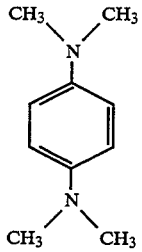

(III)-4

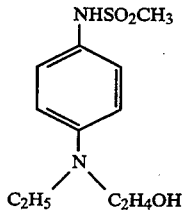

(III)-5

-continued
(III)-6
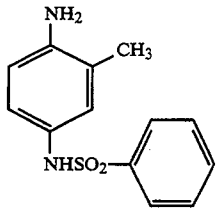
(III)-7
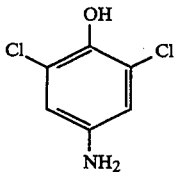
(III)-8
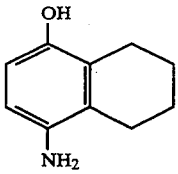
(III)-9
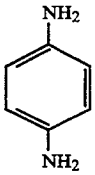
(III)-10
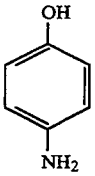
(III)-11
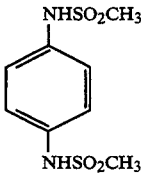
(II)-12
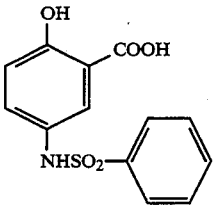
(III)-13
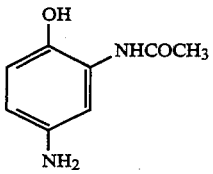
-continued
(III)-14
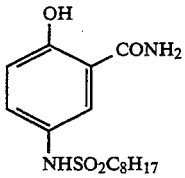
(III)-15
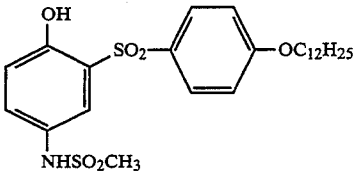
(III)-16
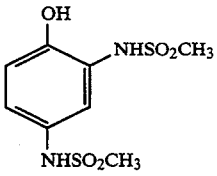
(IV)-1
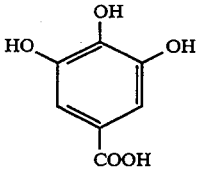
(IV)-2
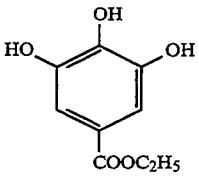
(IV)-3
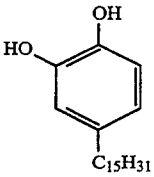
(IV)-4
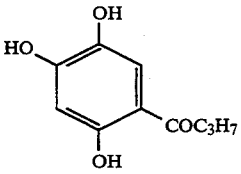
(IV)-5
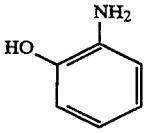
(IV)-6
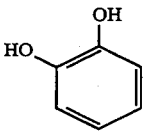

-continued
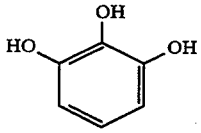
(IV)-7
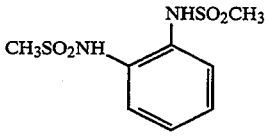
(IV)-8
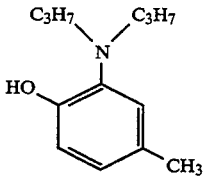
(IV)-9
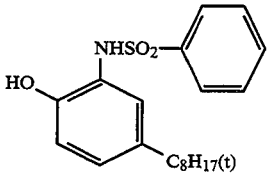
(IV)-10
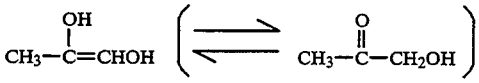
(IV)-11
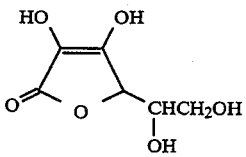
(IV)-12
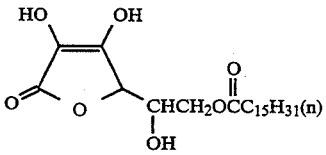
(IV)-13
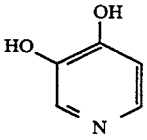
(IV)-14
$NH_2NH_2$ (V)-1
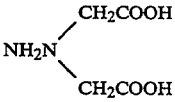
(V)-2
$CH_3CONHNH_2$ (V)-3
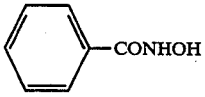
(V)-4
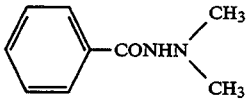
(V)-5
-continued
$NH_2CONHNH_2$ (V)-6
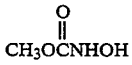
(V)-7
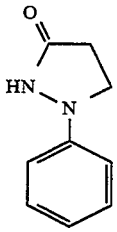
(V)-8
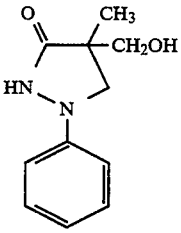
(V)-9
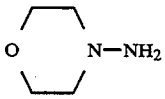
(V)-10
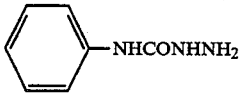
(V)-11
$NH_2NHCONHNH_2$ (V)-12
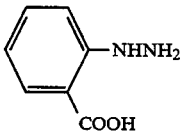
(V)-13
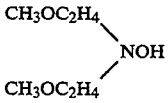
(V)-14
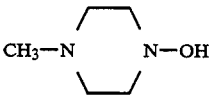
(V)-15
$CH_3NHNHCH_3$ (V)-16
$(t)C_4H_9NHOH$ (V)-17
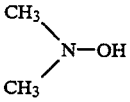
(V)-18

-continued (V)-19

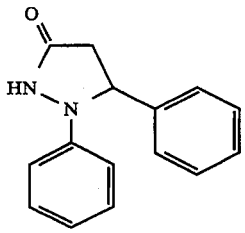

(V)-20

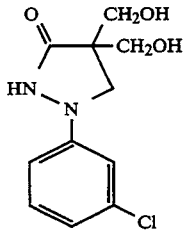

(V)-21

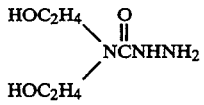

(V)-22

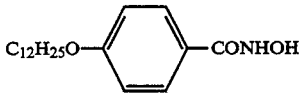

(V)-23

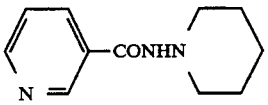

(V)-24

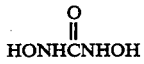

(V)-25

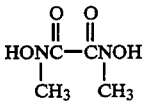

(V)-26

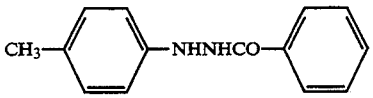

(V)-27

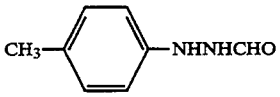

In order to prevent fogging during the production step of the photographic material, during the storage thereof, or during the photographic processing, or in order to stabilize the photographic performance thereof, various compounds or their precursors can be added to the silver halide emulsion for use in the present invention. Specific examples of these compounds are preferably those described in the above-mentioned JP-A No. 215272/1987, pages 39 to 72. Further, 5-arylamino-1,2,3,4-thiatriazole compounds (whose respective aryl residues have at least one electron-attracting group) described in EP 0447647 are also preferably used.

Spectral sensitization is carried out for the purpose of spectral sensitizing the emulsion of each layer of the photographic material to a desired wavelength region of light.

In the photographic material of the present invention, as spectral sensitizing dyes used for spectral sensitizing the blue, green, and red regions, those described by F. M. Harmer in *Heterocyclic compounds-Cyanine dyes and related compounds* (John Wiley & Sons (New York, London), 1964) can be mentioned. As specific examples of the compounds and specific examples of the spectral sensitization method, those described in the above-mentioned JP-A No. 215272/1987, page 22 (the right upper column) to page 38, are preferably used. In particular, as red-sensitive spectral sensitizing dyes for silver halide emulsion grains high in the silver chloride content, spectral sensitizing dyes described in JP-A No. 123340/1991 are very preferred in view, for example, of stability, strong adsorption, and temperature dependence of exposure to light.

When the photographic material of the present invention is to be effectively spectral sensitized to the infrared region, sensitizing dyes described in JP-A No. 15049/1991, page 12 (the left upper column) to page 21 (the left lower column); JP-A No. 20730/1991, page 4 (the left lower column) to page 15 (the left lower column); EP-0,420,011, page 4, line 21, to page 6, line 54; EP-0,420,012, page 4, line 12, to page 10, line 33; EP-0,443,466, and U.S. Pat. No. 4,975,362 are preferably used.

In order to incorporate these spectral sensitizing dyes in the silver halide emulsion, they may be directly dispersed into the emulsion, or they may be first dissolved in a solvent, such as water, methanol, ethanol, propanol, methyl Cellosolve, and 2,2,3,3-tetrafluoropropanol, which solvent may alone or a mixture, and then the solution is added to the emulsion. Also the spectral sensitizing dye may be made together with an acid or base into an aqueous solution as described in JP-B Nos. 23389/1969, 27555/1969, and 22089/1972, or the dye may be made together with a surface-active agent into a colloid dispersion and the dispersion may be added to the emulsion, as described in U.S. Pat. Nos. 3,822,135 and 4,006,025. Also after the spectral sensitizing dye may be dissolved in a solvent substantially immiscible with water, such as phenoxyethanol, which solution is then dispersed in water or a hydrophilic colloid and is added to the emulsion. Also the spectral sensitizing dye may be directly dispersed into a hydrophilic colloid, as described in JP-A Nos. 102733/1978 and 105141/1983, which dispersion is added to the emulsion. The spectral sensitizing agent may be added to the emulsion at any time at any stage during the preparation of the emulsion that is known to be useful. That is, the timing of the addition may be selected from the point before or during the formation of the grains of the silver halide emulsion; the point immediately after the formation of the grains and before the washing step; the point before and during the chemical sensitization; the point immediately after the chemical sensitization and before the end of the solidification of the emulsion by cooling; and the point of the preparation of the coating solution. Most generally the addition is carried out at the point after the completion of the chemical sensitization and before the application, but, as described in U.S. Pat. Nos. 3,628,969 and 4,225,666, the spectral sensitizing dye may be added simultaneously with the chemical sensitizer, to carry out the spectral sensitization simultaneously with the chemical sensitization, or, as described in JP-A No. 113928/1983, the spectral sensitizing dye may be added prior to the chemical sensitization, or the spectral sensitizing dye may be added before the completion of the precipitation of the silver halide grains to start the spectral sensitization. Further, as taught in U.S. Pat. No. 4,224,666, the spectral sensitizing dye may be added in portions, that is, a part of the spectral sensitizing dye may be added prior to the chemical sensitization and the rest may be added after the chemical sensitization and also the spectral sensitizing dye may be added at any time during the formation of the silver halide grains, for example, as taught in U.S. Pat. No. 4,183,756. Among the above in particular, preferably the spectral sensitizing dye is added before the step of washing the emulsion or before the chemical sensitization.

The amount of these spectral sensitizing dyes to be added varies widely depending on the case, and is preferably in the range of $0.5\times10^{-6}$ to $1.0\times10^{-2}$ mol, more preferably $1.0\times10^{-6}$ to $5.0\times10^{-3}$ mol, per mol of the silver halide.

In the present invention, when a sensitizing dye having a spectral sensitizing sensitivity particularly to from the red region to the infrared region, preferably compounds described in JP-A No. 157749, page 13 (the right lower column) to page 22 (the right lower column), are used additionally. By using these compounds, the preservability of the photographic material, the stability of the processing of the photographic material, and the supersensitizing effect can be specifically enhanced. In particular, the additional use of compounds of formulas (IV), (V), and (VI) disclosed in the above patent is particularly preferable. These compounds are used in an amount of $0.5\times10^{-5}$ to $5.0\times10^{-2}$ mol, preferably $5.0\times10^{-5}$ to $5.0\times10^{-3}$ mol, per mol of the silver halide and the advantageous amount to be used lies in the range of 0.1 to 10,000 times, preferably 0.5 to 5,000 times, 1 mol of the sensitizing dye.

The color photographic material of the present invention can be formed by applying at least one yellow-color-forming silver halide emulsion layer, at least one magenta-color-forming silver halide emulsion layer, and at least one cyan-color-forming silver halide emulsion layer on a support having a reflective layer. In a common color photographic printing paper, by adding couplers capable of forming dyes having relationships complementary to lights to which the silver halide emulsions are sensitive, the color can be reproduced by the subtractive color process. A common color photographic printing paper can be formed in such a manner that silver halide emulsion grains are spectrally sensitized with a blue-sensitive spectral sensitizing dye, a green-sensitive spectral sensitizing dye, and a red-sensitive spectral sensitizing dye, in the order of the above color-forming layers, and they are applied on a support in the above-stated order. However, the order may be different. In view of the rapid processing, there is a case wherein a photosensitive layer containing silver halide grains having the greatest average grain size is preferably the uppermost layer; or in view of the preservability under exposure to light, there is a case wherein the lowermost layer is preferably a magenta color-forming photosensitive layer.

The photosensitive layers and the hues that will be formed by color forming may be formed not to have the above correspondence, and at least one infrared photosensitive silver halide emulsion layer can be used.

The photosensitive material of the present invention is used in a print system using usual negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the photographic material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the photographic material can be present in each of the blue region, the green region, and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III-V group semiconductor laser is present now only in from the red region to the infrared region. However, on the laboratory level, the oscillation of a II-VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the photographic material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture size is exposed with the density of the picture element being 400 dpi, preferably the exposure time is $10^{-4}$ sec or less, more preferably $10^{-6}$ sec or less. Further, preferably the exposure time is $10^{-4}$ to $10^{-10}$ sec, more preferably $10^{-6}$ to $10^{-10}$ sec.

In the photographic material according to the present invention, for the purpose of preventing irradiation or halation or of improving, for example, safelight immunity, preferably a dye, which can be decolored by processing (in particular, an oxonol dye or a cyanine dye), as described in European Patent EP 0337490A2, pages 27 to 76, is added to the hydrophilic colloid layer.

Some of these water-soluble dyes deteriorate the color separation or the safelight immunity if the amount thereof to be used is increased. As a dye that can be used without deteriorating the color separation, a watersoluble dye described, for example, in EP 0539978A1 and JP-A Nos. 127325/1993 and 127324/1993 is preferable.

In the present invention, instead of or in combination with the water-soluble dye, a colored layer capable of being decolored by processing is used. The colored layer used that can be decolored by processing may be arranged in contact with the emulsion layer directly or through an intermediate layer containing a processing color-mix inhibitor, such as gelatin and hydroquinone. This colored layer is preferably located under the emulsion layer (on the side of the support) that will form a primary color which is the same as that of the colored layer. Colored layers corresponding to respective primary colors may all be arranged, or only some of them may be arbitrarily selected and arranged. A colored layer that has been colored to correspond to several primary color regions can also be arranged. The optical reflection density of the colored layer is preferably such that the value of the optical density at the wavelength at which the optical density is highest in the wavelength region used for the exposure (in the visible light region of 400 nm to 700 nm in a usual printer exposure and in the wavelength of the scanning exposure light source to be used in the case of scanning exposure) is 0.2 or higher but 3.0 or lower, more preferably 0.5 or higher but 2.5 or lower, and particularly preferably 0.8 or higher but 2.0 or lower.

To form the colored layer, conventionally known methods can be applied. For instance, a method wherein a dye described in JP-A No. 282244/1990, page 3 (the right upper column) to page 8, or a dye described in JP-A No. 7931/1991, page 3 (the right upper column) to page 11 (the left lower column), is brought into the form of a solid fine particle dispersion and is allowed to be contained in a hydrophilic colloid layer; a method wherein an anionic dye is fixed to a cationic polymer; a method wherein a dye is adsorbed to fine particles, for example, of a silver halide and is fixed into a layer; or a method wherein colloidal silver is used as described in JP-A No. 239544/1988; can be mentioned. As the method for dispersing a fine powder of a dye in the solid state, for example, a method is described in JP-A No. 308244/1990, pages 4 to 13, wherein a fine powder dye, which is substantially insoluble in water at a pH of at least 6 or below, but which is substantially soluble in water at a pH of at least 8, is incorporated. Further, a method wherein an anionic dye is fixed to a cationic polymer is described in JP-A No. 84637/1990, pages 18 to 26. Methods for preparing colloidal silver as a light-absorbing agent are described in U.S. Pat. Nos. 2,688,601 and 3,459,563. Out of these methods, the method wherein a fine powder dye is incorporated, and the method wherein colloidal silver is used, are preferred.

As a binder or protective colloid that can be used in the photographic material according to the present invention, gelatin is advantageously used, but some other hydrophilic colloid can be used alone or in combination with gelatin. As a gelatin, preferably low-calcium gelatin having a calcium content of 800 ppm or less, more preferably 200 ppm or less, is used. In order to prevent various fungi or bacteria from propagating in the hydrophilic colloid layer to deteriorate the image quality, preferably a mildew-proofing agent, as described in JP-A No. 271247/1988, is added.

When the photographic material of the present invention is subjected to printer exposure, preferably a band strip filter described in U.S. Pat. No. 4,880,726 is used. Thus, light color mixing is eliminated and color reproduction is remarkably improved.

An exposed photographic material can be subjected to conventional color development processing, and, in the case of the color photographic material of the present invention, to make the processing rapid, preferably after it is color-developed, it is bleach-fixed. Particularly, when the above high-silver-chloride emulsion is used, the pH of the bleach-fix solution is preferably about 6.5 or below, more preferably 6 or below, for the purpose, for example, of accelerating desilvering.

As the silver halide emulsion to be applied to the photographic material of the present invention and the other materials (e.g., additives) and the photographic constitutional layers (including the arrangement of the layers) to be applied thereto and the processing method and additives used in the processing of the photographic material of the present invention, those described in the below-mentioned patent gazettes, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing | p. 22 upper right column line 8 from the bottom to p. 38 | p. 30 upper left column lines 1 to 13 | p. 47 lines 10 to 15 |

-continued

| Element constituting photographic material | JP-A No. 215272/1987 | JP-A No. 33144/1990 | EP 0,355,660A2 |
|---|---|---|---|
| agent (method) | last line | | |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development inhibitor | p. 155 lower right column lines 3 to 9 | — | — |
| Support | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p .184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 17 |
| Surface-active agent | p. 201 lower left column line 1 to p. 210 upper right column last line | P.18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | |
| Binder (Hydrophilic | p. 222 lower left column line 60 to p. 225 upper left | p. 38 upper right column lines 8 to 18 | p. 66 lines 23 to 28 |

-continued

| Element constituting photographic material | JP-A No. 215272/1987 | JP-A No. 33144/1990 | EP 0,355,660A2 |
|---|---|---|---|
| colloid) | column last line | | |
| Thickening agent | p. 225 upper right column line 1 to p. 227 upper right column line 2 | — | — |
| Antistatic agent | p. 227 upper right column lin 3 to p. 230 upper left column line 1 | — | — |
| Polymer latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note: In the cited part of JP-A No. 215272/1987, amendment filed on March 16, 1987 is included. Further, among the above-mentioned couplers, it is preferred to use so called short wavelength-type yellow coupler, described in JP-A Nos. 231451/1988, 123047/1988, 241547/1988, 173499/1989, 213648/1989, and 250944/1989, as a yellow coupler.

Preferably, the cyan, magenta, and yellow couplers are impregnated into loadable latex polymers (e.g., loadable latex polymers described in U.S. Pat. No. 4,203,716) in the presence or absence of a high-boiling organic solvent listed in the above table, or they are dissolved together with water-insoluble and organic solvent-soluble polymers and are emulsified and dispersed into hydrophilic colloid aqueous solution. As water-insoluble and organic solvent-soluble polymers that can be preferably used, homopolymers or copolymers described in U.S. Pat. No. 4,857,449, the seventh column to the fifteenth column, and in International Publication No. WO 88/00723, pages 12 to 30, can be mentioned. More preferably, methacrylate-type polymers or acrylamide-type polymers, particularly acrylamide-type polymers, are used in view of color image stability and the like.

In the photographic material according to the present invention, color image preservability improving compounds as described in European Patent EP 0277589A2 are preferably used together with couplers, particularly, together with pyrazoloazole couplers and pyrrolotriazole couplers.

That is, the use of a compound described in the above-mentioned patent specifications that combines with the aromatic amine developing agent remaining after the color development processing to form a chemically inactive and substantially colorless compound and/or a compound described in the above-mentioned patent specifications that combines with the oxidized product of the aromatic amine color developing agent remaining after the color development processing to form a chemically inactive and substantially colorless compound simultaneously or singly is preferable. This is because, for example, the occurrence of stain or other side effects due to the formation of color formed dyes by the reaction of the color developing agent or its oxidized product remaining in the film during the storage after the processing with couplers can be prevented.

Further, as the cyan couplers, in addition to diphenylimidazole cyan couplers described in JP-A No. 33144/1090, 3-hydroxypyridine cyan couplers described in European Patent EP 0333185A2 (particularly, that formed by attaching a chlorine coupling-off group to the 4-equivalent coupler of Coupler (42) to make it to be 2-equivalent and Couplers (6) and (9) which are listed as specific examples are preferable), cyclic active methylene cyan couplers described in JP-A No. 32260/1989 (particularly Coupler Examples 3, 8, and 34 that are listed as specific examples are preferable), pyrrolopyrazole cyan couplers described in European Patent EP 0456226A1, pyrroloimidazole cyan couplers described in European Patent EP 0484909, and pyrrolotirazole cyan couplers described in European Patents EP 0488248 and EP 491197A1 are preferably used. Among them, pyrrolotriazole cyan couplers are particularly preferably used.

As the yellow couplers, in addition to the compounds listed in the above table, acylacetamide yellow couplers whose acyl group has a 3- to 5-membered cyclic structure described in European Patent EP 0447969A1, malondianilide yellow coupler having a cyclic structure described in European Patent EP 0482552A1, and acylacetamide yellow couplers having a dioxane structure described in U.S. Pat. No. 5,118,599 are preferably used. Among them, acylacetamide yellow couplers whose acyl group is a 1-alkylcyclopropane-1-carbonyl group and malondianilide yellow couplers wherein one of the anilide constitutes an indoline ring are preferably used. These couplers can be used alone or in combination.

As the magenta couplers used in the present invention, 5-pyrazolone magenta couplers and pyrazoloazole magenta couplers as described in the known literature shown in the above table are used, but in particular, in view, for example, of the hue, the stability of images, and the color forming properties, pyrazolotriazole couplers wherein a secondary or tertiary alkyl group is bonded directly to the 2-, 3-, or 6-position of the pyrazolotriazole ring as described in JP-A No. 65245/1986, pyrazoloazole couplers containing a sulfonamido group in the molecule as described in JP-A No. 65246/1986, pyrazoloazole couplers having an alkoxyphenyl-sulfonamido ballasting group as described in JP-A No. 147254/1986, and pyrazoloazote couplers having an alkoxy group or an aryloxy group in the 6-position as described in European Patent Nos. 226,849A and 294,785A are preferably used.

As the processing method of color photographic material of the present invention, besides methods described in the above-described table, processing materials and processing method described in JP-A No.

207250/1990, p.26 (right lower column line 1) to p.34 (right upper column line 9) and in-JP-A No. 97355/1992, p. 5 (left upper column line 17) to p. 18 (right lower column line 20) are preferable.

According to the present invention, a silver halide color photographic material that is excellent in reciprocity characteristics with high-illumination-intensity exposure and excellent in latent-image stability after raw stock storage of the photographic material can be obtained. Further, the developing process of color photographic material can be carried out rapidly.

The present invention will now be described below specifically with reference to Examples, but the present invention is not restricted to them.

EXAMPLE 1

(Preparation of Base Paper)

A wood pulp mixture [bleached sulfate pulp from hardwoods and bleached sulfite pulp from softwoods (LBKP/NBSP)=2/1] was subjected to beating, to obtain 250 ml of Canadian Standard Freeness in the form of pulp slurry. After the pulp slurry was diluted with water, based on the pulp weight, 1.0% of an anionic polyacrylamide (Polystrone 195, molecular weight: about 110,000, manufactured by Arakawa Kagaku KK), 1.0% of aluminum sulfate, and 0.15% of a polyamide polyamine epichlorohydrin (available under the trade name Kaimen 557, manufactured by DIC Hercules Co.) were added with stirring. Then based on the pulp weight, 4.0 wt. % of epoxidized behenic acid amide and 4.0 wt. % of an alkylketene dimer (whose alkyl group is $C_{20}H_{41}$) were added; then sodium hydroxide was added, to bring the pH to 7, and 0.5 wt. % of a cationic polyacrylamide and 0.1 wt. % of an antifoamer were added. The thus prepared pulp slurry was made into a sheet of paper having a basis weight of 180 g/m$^2$.

The water content of the thus prepared base paper was brought by an oven to about 2 wt. %, and then the base paper was size-pressed with an aqueous solution having the following formulation as a surface sizing solution, so that the coating amount of the solution on the surface of the base paper (on the side where photographic emulsions would be applied) might be 20 g/m$^2$.

| | |
|---|---|
| Poly(vinyl alcohol): | 4.0 wt % |
| Calcium chloride: | 4.0 wt % |
| Fluorescent brightening agent: | 0.5 wt % |
| Antifoamer: | 0.005 wt % |

The thickness of the paper after size-press treated was adjusted by a machine calender to 180 μm.

(Preparation of a Support)

A mixed composition of a polyester (limiting viscosity: 6.5; molecular weight: 40,000), synthesized by condensation polymerization of dicarboxylic acid having the composition shown in Table 1 with ethylene glycol, or polyethylene and titanium oxide (KA-10, manufactured by Titan Kogyo), was melted and mixed at 300° C. by a twin-screw mixing extruder and was melt-extruded from a T-die onto the surface of the 180 μm thickness base paper, so that a lamination layer having a thickness of 30 μm might be formed. A calcium carbonate-containing polyethylene terephthalate resin composition was melt-extruded at 300° C. onto the other surface, so that a lamination layer having a thickness of 30 μm might be formed. The resin surface of this laminated reflective support, where emulsions would be applied was subjected to a corona discharge treatment and was coated with a coating solution having the following composition in an amount of 5 ml/m$^2$, and it was dried at 80° C. for 2 min, to obtain Photographic Supports 1 to 8.

[Formulation of the Undercoat]

| | |
|---|---|
| Compound ExU1 | 0.2 g |
| Compound ExU2 | 0.001 g |
| $H_2O$ | 35 ml |
| Methanol | 65 ml |
| Gelatin | 2 g |
| pH | 9.5 |

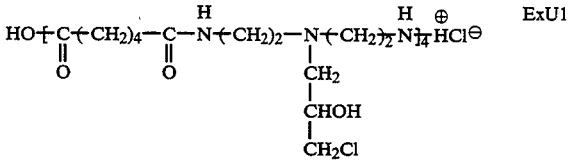

ExU1

$C_{12}H_{25}O(CH_2CH_2O)_{10}H$ ExU2

TABLE 1

| Base No. | Resin: Composition of Dicarboxylic acid | molar ratio | $TiO_2$ (wt %) |
|---|---|---|---|
| 1 | Polyester (Terephthalic acid) | 100 | 20 |
| 2 | Polyester (Terephthalic acid/ isophthalic acid) | 90/10 | 20 |
| 3 | Polyester (Terephthalic acid/ isophthalic acid) | 50/50 | 20 |
| 4 | Polyester (Terephthalic acid/ Naphthalenedicarboxylic acid | 90/10 | 20 |
| 5 | Polyester (Terephthalic acid Naphthalenedicarboxylic acid | 50/50 | 20 |
| 6 | Polyethylene | | 15 |
| 7 | Polyester (Terephthalic acid) | 100 | 5 |
| 8 | Polyester (Terephthalic acid) | 100 | 40 |

(Preparation of Silver Halide Emulsion B1 for a blue-sensitive silver halide emulsion layer)

3.3 Grams of sodium chloride was added to a 3% aqueous lime-processed gelatin solution, and then 3.01 ml of N,N'-dimethylimidazolidine-2-thion (a 1% aqueous solution) was added. To this aqueous solution were added, and mixed, an aqueous solution containing 0.5 mol of silver nitrate and an aqueous solution containing 0.5 mol of sodium chloride, at 70° C. with vigorous stirring. Then, an aqueous solution containing 0.45 mol of silver nitrate and an aqueous solution containing 0.45 mol of sodium chloride were added and mixed, at 72° C. with vigorous stirring. Thereafter a copolymer of isobutene/monosodium maleate was added at 40° C., followed by settling and washing, to remove the salts. Then, 90.0 g of lime-processed gelatin was added further. To this emulsion was added a silver-bromide fine-grain emulsion having a grain size of 0.05 μm, in an amount of 0.0030 mol in terms of silver, to form a silver bromide-rich layer on the grain surface; then a blue-sensitive sensitizing dye was added in an amount of $2\times10^{-4}$ mol per mol of Ag, and the emulsion was subjected to chemical sensitization optimally with a sulfur sensitizer (triethylthio urea). Further, 1-(5-methylureidopheyl)-5-mercaptotetrazole was added in an amount of $5\times10^{-4}$ mol per mol of Ag.

The shape of the grains, the grain size, and the grain size distribution of the thus obtained Emulsion (B1 ) were determined from electromicrophotographs. The emulsion grains were cubic, the grain size was 0.88 μm, and the deviation coefficient was 0.10. The grain size was represented by the average value of the diameters of circles equivalent to the projected areas of the grains, and the grain size distribution used the values obtained by dividing the standard deviation of the grain sizes by the average grain size.

By changing the temperature at which the silver halide grains were formed, the time at which the aqueous silver nitrate solution and the aqueous sodium chloride solution were added, and the amount of the silver bromide fine-grains emulsion, emulsions different in grain size were prepared, and a red-sensitive sensitizing dye or a green-sensitive sensitizing dye was added, to prepare a red-sensitive emulsion and a green-sensitive emulsion.

Emulsions B2 to B11, as shown in Table 2, were prepared using the same procedure for the preparation of Emulsion B1, except that, to the aqueous solution added 0.5 mol of sodium chloride after the addition of the aqueous solution containing 0.5 mol of silver nitrate and the aqueous solution containing 0.5 mol of sodium chloride, was added iridium(III) chloride, potassium hexachlororhodium, or yellow prussiate.

TABLE 2

| Emulsion | Species of metal ion | Added amount of metal ion (mol/mol of Ag) |
|---|---|---|
| B1 | — | — |
| B2 | Iridium | $1 \times 10^{-10}$ |
| B3 | Iridium | $1 \times 10^{-9}$ |
| B4 | Iridium | $1 \times 10^{-3}$ |
| B5 | Iridium | $1 \times 10^{-2}$ |
| B6 | Iron | $1 \times 10^{-9}$ |
| B7 | Iron | $1 \times 10^{-3}$ |
| B8 | Iron | $1 \times 10^{-2}$ |
| B9 | Rhodium | $1 \times 10^{-9}$ |
| B10 | Rhodium | $1 \times 10^{-3}$ |
| B11 | Rhodium | $1 \times 10^{-2}$ |

Spectral sensitizing dyes shown below were used in respective silver chlorobromide emulsions of photosensitive emulsion layers. Blue-sensitive emulsion layer:

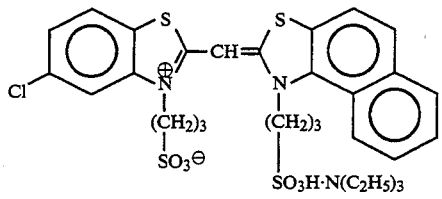

and

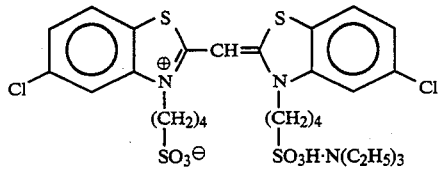

(each $2.0 \times 10^{-4}$ mol per mol of silver halide.)

Green-sensitive emulsion layer:

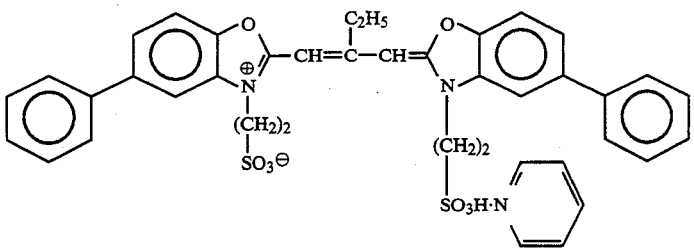

($4.0 \times 10^{-4}$ mol per mol of silver halide) and

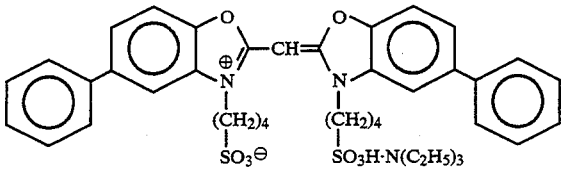

($7.0 \times 10^{-5}$ mol per mol of silver halide)

Red-sensitive emulsion layer:

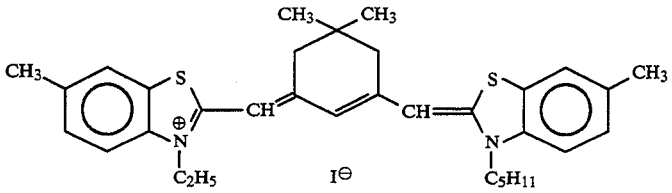

($1.0 \times 10^{-4}$ mol per mol of silver halide)

Further, the following compound was added in an amount of $2.6 \times 10^{-3}$ mol per mol of silver halide:

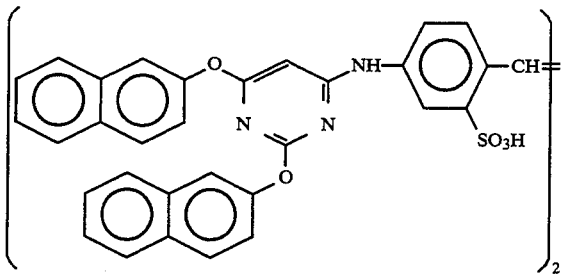

Photographic constitutional layers shown below were applied on the support i shown in Table 1, thereby preparing a multilayer color photographic printing paper Sample (1) having layer composition shown below. Coating solutions were prepared as follows.

Preparation of the first layer coating solution 153.0 Grams of yellow coupler (ExY), 15.0 g of image-dye stabilizer (Cpd-1), 7.5 g of image-dye stabilizer (Cpd-2), and 16.0 g of image-dye stabilizer (Cpd-3) were dissolved in 180 ml of ethyl acetate, 25 g of solvent (Solv-1) and 2B g of solvent (Solv-2) and the resulting solution was dispersed and emulsified in 1,000 g of 10% aqueous gelatin solution containing 60 ml of 10% sodium dodecylbenzenesulfonate solution and 10 g of citric acid, thereby prepared emulsified dispersion A.

Separately silver chlorobromide emulsion (emulsion B1, cubic grains having 0.88 μm of average grain size and 0.10 of deviation coefficient of grain size distribution, in which 0.30 mol. % of silver bromide was located at the grain surface) was prepared in the above-described method.

The above-described emulsified dispersion A and this silver chlorobromide emulsion were mixed together and dissolved to give the composition shown below, thereby preparing the first layer coating solution.

Coating solutions for the other layers were also prepared in the same manner as the coating solution of first layer.

As a gelatin hardening agent for the respective layers, Exemplified compound (I-1) was used. The added amount was 15 mg/g of gelatin.

Further, Cpd-15 and Cpd-16 were added in each layer in such amounts that the respective total amount becomes 25.0 mg/m$^2$ and 50.0 mg/m$^2$.

Further, 1-(5-methylureidophenyl)-5-mercaptotetrazole was added to the green-sensitive emulsion-layer and the red-sensitive emulsion layer in amount of $9.7\times10^{-4}$ mol and $5.5\times10^{-4}$ mol, per mol of silver halide, respectively.

Further, 4-hydroxy-6-methyl-l,3,3*a*,7tetrazaindene was added to the blue-sensitive emulsion layer and the green-sensitive emulsion layer in amount of $1\times10^{-4}$ mol and $2\times10^{-4}$ mol, per mol of silver halide, respectively.

Further, Exemplified compound (IV-13) was added to the blue-sensitive emulsion layer in an amount of $7.7\times10^{-4}$ mol per mol of silver halide.

The dyes shown below (figure in parentheses represents coating amount) were added to the emulsion layers for prevention of irradiation.

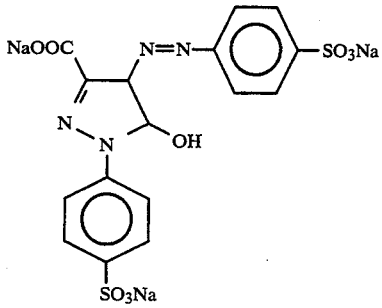

(10 mg/m$^2$)

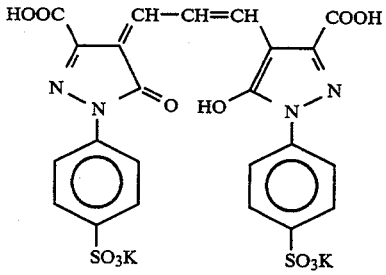

(10 mg/m$^2$)

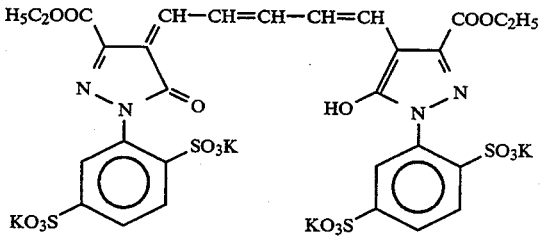

(40 mg/m$^2$)

-continued and

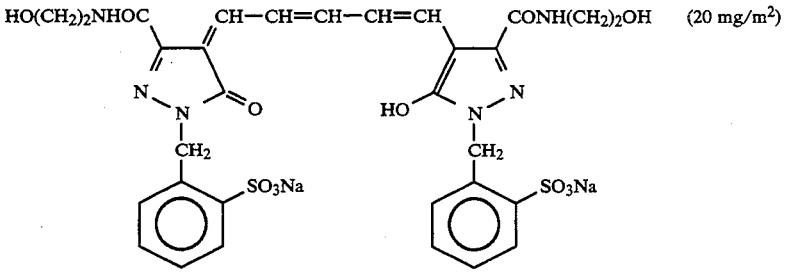

(Composition of Layers)

The composition of each layer is shown below. The figures represent coating amount (g/m$^2$). The coating amount of each silver halide emulsion is given in terms of silver.

Support

Support 1 described in Table 1

| | |
|---|---|
| First Layer (Blue-sensitive emulsion layer) | |
| Silver chlorobromide emulsion (cubic grains, Emulsion B1 having average grain size of 0.88 μm, whose deviation coefficient of grain size distribution was 0.10, in which emulsion 0.3 mol % of AgBr was located at a part of grain surface, wherein silver halide other than above AgBr was AgCl) | 0.27 |
| Gelatin | 1.36 |
| Yellow coupler (ExY) | 0.79 |
| Image-dye stabilizer (Cpd-1) | 0.08 |
| Image-dye stabilizer (Cpd-2) | 0.04 |
| Image dye stabilizer (Cpd-3) | 0.08 |
| Solvent (Solv-1) | 0.13 |
| Solvent (Solv-2) | 0.13 |
| Second Layer (Color-mix preventing layer) | |
| Gelatin | 0.99 |
| Color-mix inhibitor (Cpd-4) | 0.08 |
| Solvent (Solv-2) | 0.25 |
| Solvent (Solv-3) | 0.25 |
| Third Layer (Green-sensitive emulsion layer) | |
| Silver chlorobromide emulsion (cubic grains, Emulsion Gl having average grain size of 0.55 μm, whose deviation coefficient of grain size distribution was 0.10, in which emulsion 0.8 mol % of AgBr was located at a part of grain surface, wherein silver halide other than above AgBr was AgCl) | 0.13 |
| Gelatin | 1.45 |
| Magenta coupler (Exm) | 0.16 |
| Image-dye stabilizer (Cpd-6) | 0.15 |
| Image-dye stabilizer (Cpd-2) | 0.03 |
| Image-dye stabilizer (Cpd-7) | 0.01 |

-continued

| | |
|---|---|
| Image-dye stabilizer (Cpd-8) | 0.01 |
| Image-dye stabilizer (Cpd-9) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 0.70 |
| Color-mix inhibitor (Cpd-4) | 0.04 |
| color-mix inhibitor (Cpd-5) | 0.02 |
| Solvent (Solv-2) | 0.18 |
| Solvent (Solv-3) | 0.18 |
| Fifth Layer (Red-sensitive emulsion layer) | |
| Silver chlorobromide emulsion (cubic grains, Emulsion R1 having average grain size of 0.50 μm, whose deviation coefficient of grain size distribution was 0.08, in which emulsion 0.5 mol % of AgBr was located at a part of grain surface, wherein silver halide other than above AgBr was AgCl) | 0.20 |
| Gelatin | 0.85 |
| Cyan coupler (ExC) | 0.33 |
| Ultraviolet absorber (UV-2) | 0.18 |
| Image-dye stabilizer (Cpd-1) | 0.33 |
| Image-dye stabilizer (Cpd-10) | 0.15 |
| Image-dye stabilizer (Cpd-11) | 0.15 |
| Image-dye stabilizer (Cpd-12) | 0.01 |
| Image-dye stabilizer (Cpd-9) | 0.01 |
| Image-dye stabilizer (Cpd-8) | 0.01 |
| Solvent (Solv-6) | 0.22 |
| Solvent (Solv-1) | 0.01 |
| Sixth Layer (Ultraviolet absorbing layer) | |
| Gelatin | 0.55 |
| Ultraviolet absorber (UV-1) | 0.40 |
| Image-dye stabilizer (Cpd-13) | 0.15 |
| Image-dye stabilizer (Cpd-6) | 0.02 |
| Seventh Layer (Protective layer) | |
| Gelatin | 1.13 |
| Acryl-modified copolymer of polyvinyl alcohol (modification degree: 17%) | 0.15 |
| Liquid paraffin | 0.03 |
| Image-dye stabilizer (Cpd-14) | 0.01 |

Compounds used were as follows:

(ExY) Yellow coupler

Mixture ((a):(b) = 1:1 in molar ratio) of (a) R = 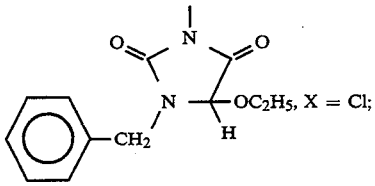

-continued
(b) R = O 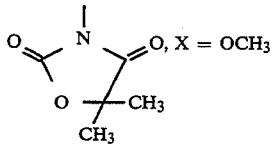 , X = $OCH_3$
of the following formula
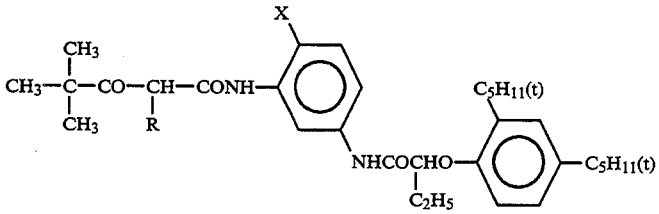
(ExM) Magenta coupler
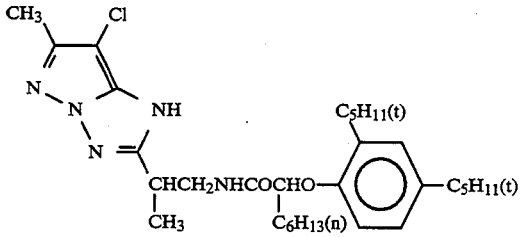
(ExC) Cyan coupler
Mixture (3:7 in molar ratio) of
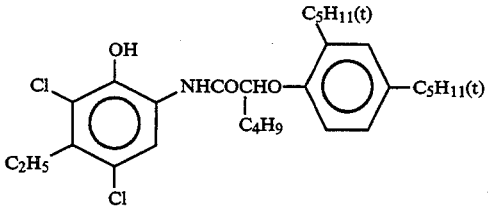
and
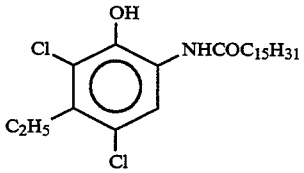
(Cpd-1) Image-dye stabilizer
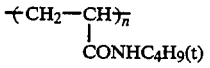
Av. molecular weight: 60,000
(Cpd-2) Image-dye stabilizer
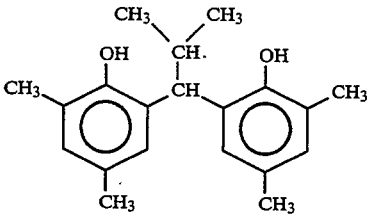
(Cpd-3) Image-dye stabilizer
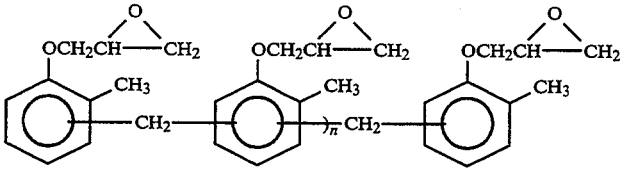
n = 7–8 (in average)
(Cpd-4) Color-mix inhibitor -continued
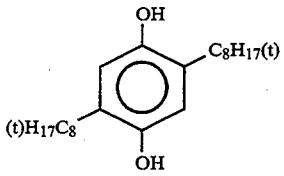
(Cpd-5) Image-dye stabilizer
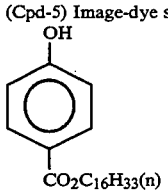
(Cpd-6) Image-dye stabilizer
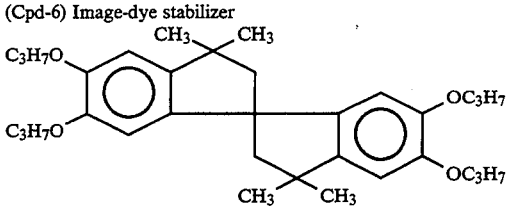
(Cpd-7) Image-dye stabilizer
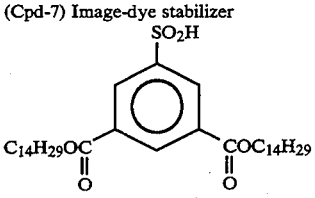
(Cpd-8) Image-dye stabilizer
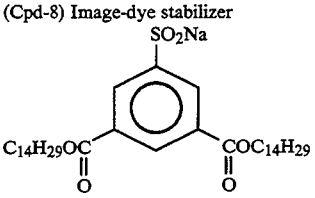
(Cpd-9) Image-dye stabilizer
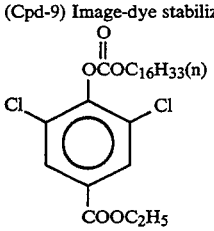
(Cpd-10) Image-dye stabilizer
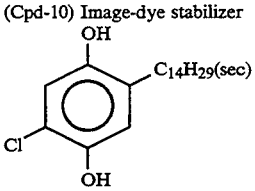
(Cpd-11) Image-dye stabilizer
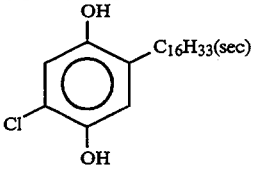
(Cpd-12) Image-dye stabilizer -continued
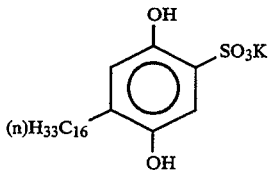
(Cpd-13) Image-dye stabilizer
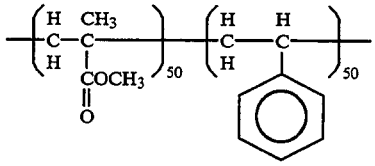
Av. molecular weight: 60,000
(Cpd-14) Image-dye stabilizer
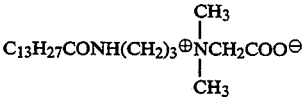
(Cpd-15) Antiseptic
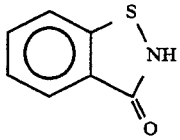
(Cpd-16) Antiseptic
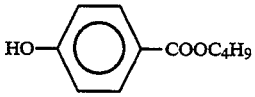
(UV-1) Ultraviolet ray absorber
Mixture of (i), (ii), (iii), and (iv) (1:5:10:5 in weight ratio)
(i)
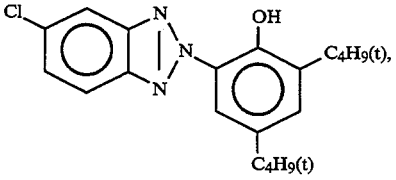
(ii)
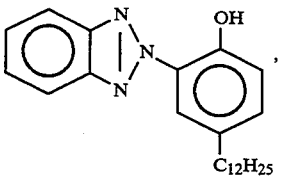
(iii)
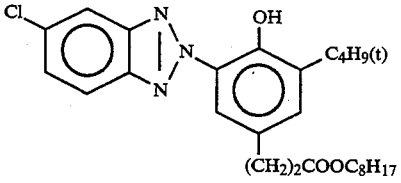
and
(iv)
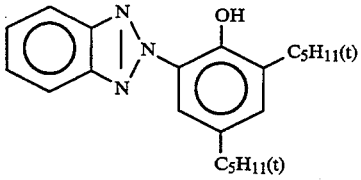
(UV-2) Ultraviolet ray absorber
Mixture of (v), (vi), and (vii) (1:2:2 in weight ratio)
(v)
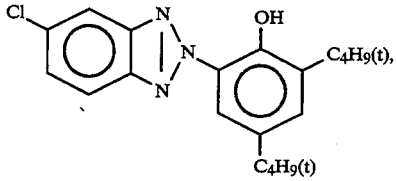
(vi)
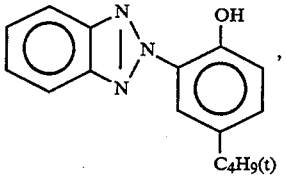
and -continued (vii)

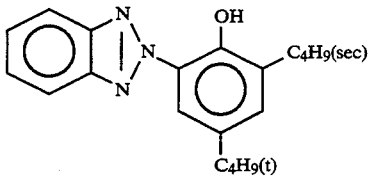

(Solv-1) Solvent $C_8H_{17}CH(O)CH(CH_2)_7COOC_8H_{17}$ (Solv-2) Solvent

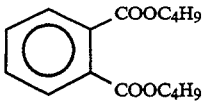

(Solv-3) Solvent

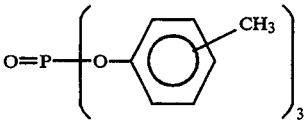

(Solv-4) Solvent

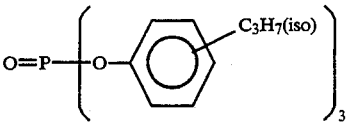

(Solv-5) Solvent $O{=}P{\leftarrow}OCH_2CH(C_2H_5)C_4H_9(n))_3$ (Solv-6) Solvent

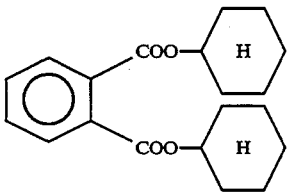

Samples (2) to (28) were prepared in the same manner as Sample (1), except that support and emulsion contained in the first layer were changed as shown in Table 3.

TABLE 3

| Sample No. | Emulsion | Support | Sample No. | Emulsion | Support |
|---|---|---|---|---|---|
| (1) | B1 | 1 | (16) | B1 | 6 |
| (2) | B2 | 1 | (17) | B2 | 6 |
| (3) | B3 | 1 | (18) | B3 | 6 |
| (4) | B4 | 1 | (19) | B4 | 6 |
| (5) | B5 | 1 | (20) | B5 | 6 |
| (6) | B6 | 1 | (21) | B6 | 6 |
| (7) | B7 | 1 | (22) | B7 | 6 |
| (8) | B8 | 1 | (23) | B8 | 6 |
| (9) | B9 | 1 | (24) | B9 | 6 |
| (10) | B10 | 1 | (25) | B10 | 6 |
| (11) | B11 | 1 | (26) | B11 | 6 |
| (12) | B3 | 2 | (27) | B3 | 7 |
| (13) | B3 | 3 | (28) | B3 | 8 |
| (14) | B3 | 4 | | | |
| (15) | B3 | 5 | | | |

To test for the reciprocity characteristics, the Samples were exposed to light for sensitometry through a blue filter using a sensitometer ( FWH-type, manufactured by Fuji Photo Film Co., Ltd.; color temperature of the light source: 3200K). The exposure to light was carried out for gradation exposure under conditions of an exposure amount of 250 CMS and exposure times of 0.1 sec or 0.02 sec, and the sensitivities were compared. The evaluation of the sensitivity was made by evaluation of the reciprocity Characteristics based on the value of the difference ($S_{0.02}$–$S_{0.1}$), wherein $S_{0.02}$ represents the sensitivity obtained when the exposure time was 0.02 sec and $S_{0.1}$ represents the sensitivity obtained when the exposure time was 0.1 sec, using the logarithm of the reciprocal number of the exposure amount required for the developed Sample to give a density of 1.0. The smaller this value was, the smaller the high-intensity failure was.

To evaluate the long-term latent-image stability of the photographic material, each Sample was stored at 25° C. and 55% relative humidity for 3 months.

The latent-image stability was evaluated by the sensitivity difference ($S_{2hr}$–$S_{Fr}$), wherein $S_{Fr}$ represents the sensitivity of the Sample that was obtained when the Sample was exposed to light for 0.1 sec in the above manner and was developed 1 min after the exposure and $S_{2hr}$ represents the sensitivity of the Sample that was obtained when the Sample was exposed to light for 0.1 sec in the above manner and was developed 2 hours after the exposure. The nearer the value of ($S_{2hr}$–$S_{Fr}$) is to zero, the more excellent the latent-stability is.

The Samples that were exposed to light were processed using a paper processor in the following processing steps with solutions having the following processing compositions.

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse | 30° C. | 90 sec | 350 ml | 10 liter |
| Drying | 70–80° C. | 60 sec | | |

Note: *Replenisher amount per $m^2$ of photographic material.

The composition of each processing solution was as follows, respectively:

| | Tank Solution | Replenisher |
|---|---|---|
| Color-developer | | |
| Water | 800 ml | 800 ml |
| Ethylenediamine-N,N,N',N'-tetramethylene phosphonic acid | 1.5 g | 2.0 g |
| Disodium 1,2-dihydroxybenzene-4,6-disulfonate | 0.5 g | 0.5 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfoneamidoesthyl)-3-methyl-4-aminoaniline sulfonate | 5.0 g | 7.0 g |
| N,N-bis(carboxymethyl)hydrazine | 4.0 g | 5.0 g |
| Sodium N,N-bis(sulfoethyl)-hydroxylamine | 4.0 g | 5.0 g |
| Fluorescent whitening agent (UVITEX CK, made by Ciba Geigy Co.) | 1.0 g | 2.0 g |
| Water to make | 1000 ml | 1000 ml |
| pH (25° C.) | 10.35 | 11.6 |
| Bleach-fixing solution (Both tank solution and replenisher) | | |
| Water | 400 ml | |
| Ammonium thiosulfate (700 g/l) | 100 ml | |
| Sodium sulfite | 17 g | |
| Iron (III) ammonium ethylenediaminetetraacetate | 55 g | |
| Disodium ethylenediaminetetraacetate | 5 g | |
| Ammonium bromide | 40 g | |
| Water to make | 1000 ml | |
| pH (25° C.) ammonium) | 6.0 | |
| Rinse solution (Both tank solution and replenisher) | | |
| Ion-exchanged water (calcium and magnesium each are 3 ppm or below) | | |

Results are shown in Table 4.

TABLE 4

| Sample No. | Reciprocity characteristics ($S_{0.02}$ – $S_{0.1}$) | Latent-image preservability: before raw storage ($S_{2\,hr}$ – $S_{Fr}$) | Latent-image preservability: after raw storage ($S_{2\,hr}$ – $S_{Fr}$) | Remarks |
|---|---|---|---|---|
| (1) | −0.07 | −0.10 | −0.09 | Comparative example |
| (2) | −0.06 | −0.08 | −0.07 | Comparative example |
| (3) | −0.01 | −0.01 | ±0 | This invention |
| (4) | ±0 | −0.01 | ±0 | This invention |
| (5) | ±0 | +0.10 | +0.11 | Comparative example |
| (6) | −0.02 | −0.01 | +0.11 | This invention |
| (7) | −0.01 | ±0 | ±0 | This invention |
| (8) | −0.01 | +0.05 | +0.06 | Comparative example |
| (9) | −0.02 | −0.01 | +0.01 | This invention |
| (10) | −0.01 | ±0 | +0.01 | This invention |
| (11) | −0.01 | +0.06 | +0.06 | Comparative example |
| (12) | −0.01 | −0.01 | ±0 | This invention |
| (13) | −0.01 | −0.01 | ±0 | This invention |
| (14) | −0.01 | −0.01 | ±0 | This invention |
| (15) | −0.01 | −0.01 | ±0 | This invention |
| (16) | −0.08 | −0.10 | −0.08 | Comparative example |
| (17) | −0.06 | −0.08 | −0.07 | Comparative example |
| (18) | −0.01 | −0.01 | +0.05 | Comparative example |
| (19) | -0.01 | −0.01 | +0.05 | Comparative example |
| (20) | ±0 | +0.10 | +0.15 | Comparative example |
| (21) | −0.02 | −0.01 | +0.05 | Comparative example |
| (22) | −0.01 | ±0 | +0.05 | Comparative example |
| (23) | −0.01 | +0.06 | +0.10 | Comparative example |
| (24) | −0.02 | −0.01 | +0.04 | Comparative example |
| (25) | −0.01 | ±0 | +0.05 | Comparative example |
| (26) | −0.01 | −0.07 | +0.11 | Comparative example |
| (27) | −0.01 | −0.01 | ±0 | This invention |
| (28) | −0.01 | −0.01 | ±0 | This invention |

From the results of Samples (16) to (26), it is apparent that, by doping with metals, the reciprocity characteristics and the latent-image stability before raw stock storage are improved. In contrast, in the Samples using supports falling outside the range of the present invention, the latent-image sensitization after raw stock storage inevitably increases considerably. It can be understood that when Samples (1) to (11) are compared with Samples (16) and (26), this deterioration of the latent-image stability after raw stock storage due to the doping with metals is decreased remarkably by changing the supports to the supports defined by the present invention.

It can be understood from Samples (12) to (15) that this effect is retained even if the kind of support is changed within the range of the present invention.

Based on the above results, a color photographic material excellent in reciprocity characteristics with high-intensity exposure and also excellent in latent-image stability can be obtained only by the combinations of the present invention.

EXAMPLE 2

Samples (29) t0 (40) were prepared in the same manner used for preparing Samples (3) and (18), except that the kind of hardening agent was changed as shown in Table 5.

As comparative hardening agents, the following Compounds (H-1) and (H-2) were used. The added amount was equimolar to that of the hardening agents of Example 1.

TABLE 5

| Sample No. | Emulsion | Support | Hardening agent | Remarks |
|---|---|---|---|---|
| (3) | B3 | 1 | I-1 | This invention |
| (18) | " | 6 | I-1 | Comparative example |
| (29) | " | 1 | I-2 | This invention |
| (30) | " | 6 | I-2 | Comparative example |
| (31) | " | 1 | I-6 | This invention |
| (32) | " | 6 | I-6 | Comparative example |
| (33) | " | 1 | II-1 | This invention |
| (34) | " | 6 | II-1 | Comparative example |
| (35) | " | 1 | II-2 | This invention |
| (36) | " | 6 | II-2 | Comparative example |
| (37) | " | 1 | H-1 | Comparative example |
| (38) | " | 6 | H-1 | Comparative example |
| (39) | " | 1 | H-2 | Comparative example |
| (40) | " | 6 | H-2 | Comparative example |

(H-1) $CH_2{=}CHSO_2CH_2CH(OH)CH_2SO_2CH{=}CH_2$
(H-2) $CH_2{=}CHSO_2CH_2CONHCH_2CH_2NHCOCH_2SO_2CH{=}CH_2$

The color image forming test including the evaluation of the Samples was carried out in the same way as in Example 1. The results are shown in Table 6.

TABLE 6

| Sample No. | Reciprocity characteristics ($S_{0.02} - S_{0.1}$) | Latent-image preservability: before raw storage ($S_{2\,hr} - S_{Fr}$) | Latent-image preservability: after raw storage ($S_{2\,hr} - S_{Fr}$) | Remarks |
|---|---|---|---|---|
| (3) | −0.01 | −0.01 | ±0 | This invention |
| (18) | −0.01 | −0.01 | +0.05 | Comparative example |
| (29) | −0.01 | −0.01 | ±0 | This invention |
| (30) | −0.01 | −0.01 | +0.06 | Comparative example |
| (31) | −0.01 | −0.01 | +0.01 | This invention |
| (32) | −0.01 | −0.01 | +0.06 | Comparative example |
| (33) | −0.01 | −0.01 | +0.01 | This invention |
| (34) | −0.01 | −0.01 | +0.07 | Comparative example |
| (35) | −0.01 | −0.01 | ±0 | This invention |
| (36) | −0.01 | 0.01 | +0.05 | Comparative example |
| (37) | −0.01 | ±0 | +0.07 | Comparative example |
| (38) | −0.01 | −0.01 | +0.10 | Comparative example |
| (39) | −0.01 | ±0 | +0.07 | Comparative example |
| (40) | −0.01 | ±0 | +0.10 | Comparative example |

From the results in Table 6 it is apparent that the latent-image stability after raw stock storage is deteriorated even if the support of the present invention is used when hardening agents falling outside the range of the present invention are used. Further it is apparent that only the combinations of the present invention exhibit the effect.

EXAMPLE 3

Samples (41) to (80) were prepared corresponding to and in the same manner as Samples (1) to (40) in Examples 1 and 2, except that compositions of the second layer, the third layer, and the fourth layer were changed as shown below.

With respect to these samples, the same evaluation as Example 1 was conducted, and the same effects as Examples 1 and 2 were found only in the case of samples according to the present invention.

| | |
|---|---|
| Second Layer (Color-mix preventing layer) | |
| Gelatin | 0.99 |
| Color-mix inhibitor (Cpd-A) | 0.04 |
| Color-mix inhibitor (Cpd-B) | 0.04 |
| Solvent (Solv-9) | 0.16 |
| Solvent (Solv-10) | 0.08 |
| Solvent (Solv-11) | 0.03 |
| Third Layer (Green-sensitive emulsion layer) | |
| Silver chlorobromide emulsion G1 | 0.12 |
| Gelatin | 1.24 |
| Magenta coupler (M-A) | 0.26 |
| Image-dye stabilizer (Cpd-17) | 0.03 |
| Image-dye stabilizer (Cpd-18) | 0.04 |
| Image-dye stabilizer (Cpd-19) | 0.02 |
| Image-dye stabilizer (Cpd-20) | 0.02 |
| Solvent (Solv-7) | 0.30 |
| Solvent (Solv-8) | 0.15 |
| Fourth Layer (Color-mix preventing layer) | |
| Gelatin | 0.70 |
| Color-mix inhibitor (Cpd-A) | 0.03 |
| Color-mix inhibitor (Cpd-B) | 0.03 |

-continued
| | |
|---|---|
| Solvent (Solv-9) | 0.11 |
| Solvent (Solv-10) | 0.06 |
| Solvent (Solv-11) | 0.02 |
(Cpd-A) Color-mix inhibitor
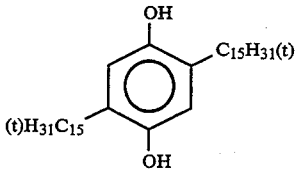
(Cpd-B) Color-mix inhibitor
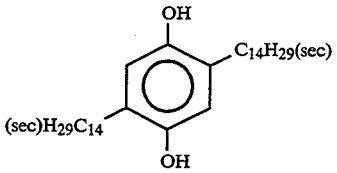
(M-A) Magenta Coupler
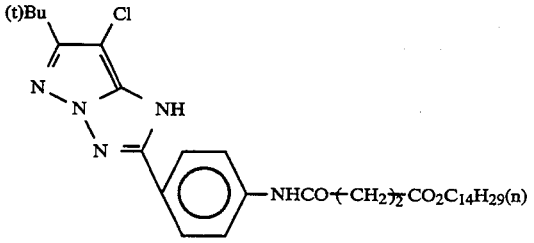
(Solv-7) Solvent
$O{=}P(O{-}C_{16}H_{13}(n))$
(Solv-8) Solvent
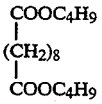
(Cpd-17) Image-dye stabilizer
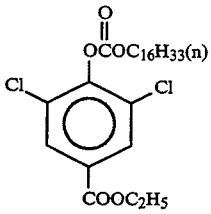
(Cpd-18) Image-dye stabilizer
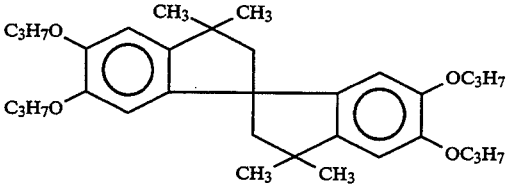
(Cpd-19) Image-dye stabilizer
Mixture (1:1 in molar ratio) of -continued

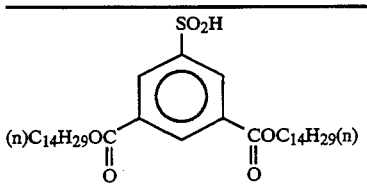

and

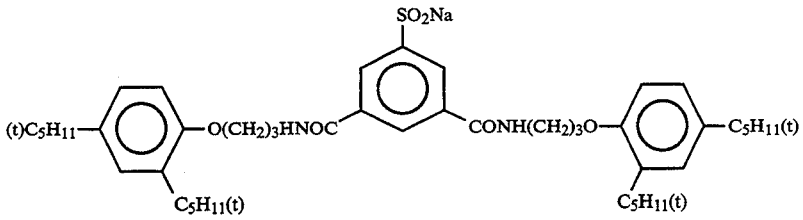

(Cpd-20) Image-dye stabilizer

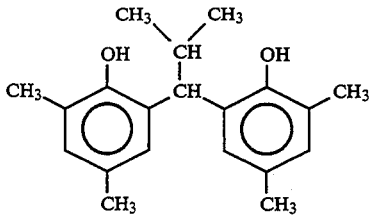

(Solv-9) Solvent

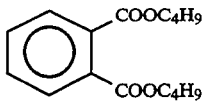

(Solv-10) Solvent

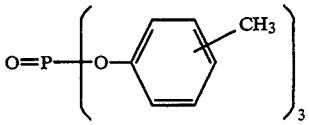

(Solv-11) Solvent

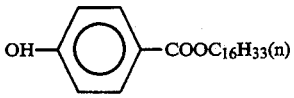

EXAMPLE 4

With respect to photographic materials prepared in Examples 1 to 3, the same color image forming test as Example 1 was conducted, except that the exposure to light was carried out as shown below. The effects according to the present invention were more remarkable other than those of Examples 1 to 3.

(Exposure to light)

The light sources used were a laser beam of wavelength 473 nm, which was taken out by wavelength conversion using an SHG crystal of $KNbO_3$ from YAG solid laser (oscillation wavelength: 946 nm), which used as an excitation light source a GaAlAs semiconductor laser (oscillation wavelength: 808.5 nm), a laser beam of wavelength 532 nm, which was taken out by wavelength conversion using an SHG crystal of KTP from $YVO_4$ solid laser (oscillation wavelength: 1064 nm), which used as an excitation light source a GaAl As semiconductor laser (oscillation wavelength: 808.7 nm), and a laser beam of AlGaInP (oscillation wavelength: about 670 nm; Type No. TOLD9211, manufactured by Toshiba Co.). The apparatus can carry out the exposure in such a manner that laser beams can scan successively a color photographic printing paper moving vertically to the direction of the scanning by respective rotating polyhedrons. Using this apparatus to change the quantity of light, the relationship D-logE between the density (D) of the photographic material and the quantity of light (E) was determined. At that time, the quantities of the lights of laser beams having three wavelengths were modulated by using an external modulator to control the exposure amount. The scanning exposure was carried out at 400 dpi and the average exposure time per picture element was about $5\times10^{-8}$ sec. The temperature of the semiconductor laser was kept by using a Peltier device to prevent the quantity of light from being changed by temperature.

EXAMPLE 5

Samples (81) to (92) were prepared in the same manner as Samples (3) and (18) in Example 1, except that, instead of Exemplified compound IV-13, compounds selected from Exemplified compounds of formulae (IV) and (V), as shown in Table 7, were used, and the same color image forming test including the evaluation as Example 1 was conducted.

Results are shown in Table 8.

TABLE 7

| Sample No. | Support | Compound represented by formula (III), (IV), or (V) Species | Added amount (mol/mol of Ag) | Remarks |
|---|---|---|---|---|
| (3) | 1 | IV-13 | $7.7\times10^{-4}$ | This invention |
| (18) | 6 | IV-13 | $7.7\times10^{-4}$ | Comparative example |
| (81) | 1 | (not added) | — | This invention |
| (82) | 6 | (not added) | — | Comparative example |
| (83) | 1 | III-16 | $7.7\times10^{-4}$ | This invention |
| (84) | 6 | III-16 | $7.7\times10^{-4}$ | Comparative example |
| (85) | 1 | IV-12 | $7.7\times10^{-4}$ | This invention |
| (86) | 6 | IV-12 | $7.7\times10^{-4}$ | Comparative example |
| (87) | 1 | V-26 | $7.7\times10^{-4}$ | This invention |
| (88) | 6 | V-26 | $7.7\times10^{-4}$ | Comparative example |
| (89) | 1 | III-16 | $7.7\times10^{-5}$ | This invention |
| (90) | 6 | III-16 | $7.7\times10^{-5}$ | Comparative example |
| (91) | 1 | III-16 | $7.7\times10^{-3}$ | This invention |
| (92) | 6 | III-16 | $7.7\times10^{-3}$ | Comparative example |

TABLE 8

| Sample No. | Reciprocity characteristics ($S_{0.02}-S_{0.1}$) | Latent-image preservability before raw storage ($S_{2\,hr}-S_{Fr}$) | Latent-image preservability after raw storage ($S_{2\,hr}-S_{Fr}$) | Remarks |
|---|---|---|---|---|
| (3) | −0.01 | −0.01 | ±0 | This invention |
| (18) | −0.01 | −0.01 | +0.06 | Comparative example |
| (81) | −0.01 | −0.01 | +0.02 | This Invention |
| (82) | −0.01 | −0.01 | +0.09 | Comparative example |
| (83) | −0.01 | −0.01 | ±0 | This Invention |
| (84) | −0.01 | −0.01 | +0.06 | Comparative example |
| (85) | −0.01 | −0.01 | ±0 | This Invention |
| (86) | −0.01 | −0.01 | +0.06 | Comparative example |
| (87) | −0.01 | −0.01 | ±0 | This invention |
| (88) | −0.01 | −0.01 | +0.07 | Comparative example |
| (99) | −0.01 | −0.01 | ±0 | This invention |
| (90) | −0.01 | −0.01 | +0.07 | Comparative example |
| (91) | −0.01 | −0.01 | ±0 | This invention |
| (92) | −0.01 | −0.01 | +0.06 | Comparative example |

As is apparent from the results in Table 8, the effects of the present invention are more remarkable in the case that compound selected from compounds represented by formulae (III ), ( IV), and (V) is contained.

Having described our invention as related to the present embodiments, it is our intention that the invention not be limited by any of the details of the description, unless otherwise specified, but rather be construed broadly within its spirit and scope as set out in the accompanying claims.

What we claim is:

1. A color photographic material having at least one yellow dye-forming coupler-containing emulsion layer, at least one magenta dye-forming coupler-containing emulsion layer, and at least one cyan dye-forming coupler-containing emulsion layer, which respective layers are different in color sensitivity from each other, on a reflective support, which comprises (i) a reflective support formed from a base paper covered with a water-resistant resin, wherein at least the water-resistant resin covering the surface to be emulsion-coated of the support is made up of a composition containing a white pigment mixed and dispersed into a thermoplastic resin whose major component is a polyester obtained by condensation polymerization of a dicarboxylic acid with a diol, (ii) at least one emulsion layer that comprises silver halide grains having a silver chloride content of 95 mol % or more and contains silver chlorobromide grains or silver chloride grains containing ions of a metal of Group VIII of the Periodic Table or a transition metal of Group II of the Periodic Table or lead or thallium ions in an amount of $10^{-9}$ mol or more per mol of the silver halide, and (iii) at least one emulsion layer that contains at least one compound represented by the following formula (IV); in which the color photographic material is hardened with a compound represented by the following formula (I) and/or a compound represented by the following formula (II); and wherein the calcium content of gelatin in the photographic material is 200 ppm or less:

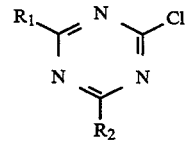

formula (I)

wherein $R_1$ represents a chlorine atom, a hydroxyl group, an alkyl group, an alkoxy group, an alkylthio group, —OM, wherein M represents a monovalent metal atom; $—NR^1R^{11}$ or $—NHCOR^{111}$ wherein $R^1$, $R^{11}$, and $R^{111}$ each represent a hydrogen atom, an alkyl group, or an aryl group; and $R_2$ has the same meaning as that of $R_1$ excluding a chlorine atom,

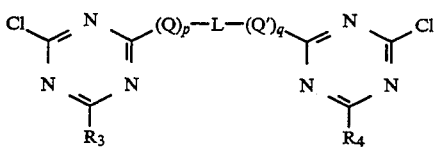

formula (II)

wherein $R_3$ and $R_4$ each represent a chlorine atom, a hydroxyl group, an alkyl group, an alkoxy group, or —OM wherein M represents a monovalent metal atom; Q and Q' each represent —O—, —S—, or —NH—; L represents an alkylene group or an arylene group; and p and q are each 0 or 1,

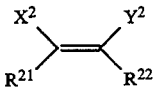

formula (IV)

wherein $X^2$ and $Y^2$ each represent a hydroxyl group, $—NR^{23}R^{24}$, or $—NHSO_2R^{25}$; $R^{21}$ and $R^{22}$ each represents a hydrogen atom or a substituent chosen from the group consisting of an alkyl group, an aryl group, an amino group, an amido group, an alkoxy group, an alkylthio group, an acyl group, a carbamoyl group, an alkoxycarbonyl group, a hydroxyl group, a halogen atom, a cyano group, a nitro group, a sulfo group, and a carboxyl group, or $R^{21}$ and $R^{22}$ may bond together to form a carbocyclic ring or a heterocyclic ring; $R^{23}$ and $R^{24}$ each represents a hydrogen atom, an alkyl group, an aryl group, or a heterocyclic group, or $R^{23}$ and $R^{24}$ may bond together to form a nitrogen-containing heterocyclic ring; and $R^{25}$ represents an alkyl group, an aryl group, an amino group, or a heterocyclic group.

2. The color photographic material as claimed in claim 1, wherein the polyester on the reflective support is one whose major component is a polyethylene terephthalate.

3. The color photographic material as claimed in claim 1, wherein the water-resistant resin covering the surface to be emulsion-coated of reflective support is made up of a composition containing a white pigment mixed and dispersed into a polyester that is a polycondensate of dicarboxylic acid, which acid is a mixture of terephthalic acid and isophthalic acid, with a diol and the other surface of the reflective support is coated with a resin or a resin composition comprising a powder or the like mixed and dispersed into the resin.

4. The color photographic material as claimed in claim 1, wherein the water-resistant resin covering the surface to be emulsion-coated of the reflective support is made up of a composition containing a white pigment mixed and dispersed into a polyester that is a polycondensate of dicarboxylic acid, which acid is a mixture of terephthalic acid and naphthalenedicarboxylic acid, with a diol and the other surface of the reflective support is coated with a resin or a resin composition comprising a powder or the like mixed and dispersed into the resin.

5. The color photographic material as claimed in claim 1, wherein the diol is selected from the group consisting of ethylene glycol, butylene glycol, neopentyl glycol, triethylene glycol, butanediol, hexylene glycol, an adduct of bisphenol A with ethylene oxide, and 7,4-dihydroxymethylcyclohexane.

6. The color photographic material as claimed in claim 1, wherein the diol is ethylene glycol.

7. The color photographic material as claimed in claim 1, wherein the white pigment is selected from the group consisting of titanium oxide, barium sulfate, lithopone, aluminum oxide, calcium carbonate, silicon oxide, antimony trioxide, titanium phosphate, zinc oxide, white lead, zirconium oxide, and finely divided powders of a polystyrene or a styrene/divinylbenzene copolymer.

8. The color photographic material as claimed in claim 1, wherein the mixing weight ratio of the white pigment to the thermoplastic resin is in the range from 98 : 2 to 30 : 70.

9. The color photographic material as claimed in claim 1, wherein the white pigment in the resin whose major component is a polyester is titanium dioxide and the weight ratio of said white pigment to said resin is from 5 : 95 to 50 : 50.

10. The color photographic material as claimed in claim 1, wherein the content of metal ions in the silver halide grains is in the range from $10^{-9}$ to $10^{-3}$ mol per mol of silver halide.

11. The color photographic material as claimed in claim 1, wherein the compound represented by formula ( I ) or ( II ) is added to at least one emulsion layer or auxiliary layer in an amount of 1 to 100 mg per gram of gelatin in the layer.

12. The color photographic material as claimed in claim 1, wherein the amount of the compound represented by formula (IV), used is in the range from $1\times10^{-5}$ to 1 mol per mol of the silver halide in the emulsion layer.

13. The color photographic material as claimed in claim 1, wherein the surface roughness of the reflective support, which is SRa value given by the following formula, is 0.15 μm or less:

$$SRa = \frac{1}{SM}\int_0^{L_X}\int_0^{L_Y} |f(X, Y)|\,dX \cdot dY$$

wherein $LxLy = SM$ $$Z = f(X_1 Y).$$

14. The color photographic material as claimed in claim 1, wherein the silver chlorobromide or silver chloride grains containing the metal ions are being subjected to gold sensitization.

15. The color photographic material as claimed in claim 1, wherein the silver chlorobromide or silver chloride grains containing the metal ions have a silver bromide-localized phase on the grain surface.

* * * * *